US006776467B2

(12) United States Patent
Yamazaki et al.

(10) Patent No.: US 6,776,467 B2
(45) Date of Patent: Aug. 17, 2004

(54) METHOD OF CONTROLLING INK JET RECORDING APPARATUS

(75) Inventors: Atsushi Yamazaki, Matshumoto (JP); Nobutoshi Otsuka, Hotaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/322,781

(22) Filed: Dec. 17, 2002

(65) Prior Publication Data

US 2003/0132980 A1 Jul. 17, 2003

(30) Foreign Application Priority Data

Jan. 16, 2002 (JP) ..... 2002-007654

(51) Int. Cl.[7] ..... B41J 2/195
(52) U.S. Cl. ..... 347/7; 347/84; 347/85
(58) Field of Search ..... 347/7, 84, 85, 347/19, 14

(56) References Cited

U.S. PATENT DOCUMENTS 5,757,390 A 5/1998 Gragg et al. ..... 347/7
6,089,686 A 7/2000 Thornton et al. ..... 347/7
6,158,850 A 12/2000 Cook ..... 347/85
2002/0085050 A1 * 7/2002 Aruga et al. ..... 347/7

FOREIGN PATENT DOCUMENTS

EP 1 142 713 10/2001

* cited by examiner

*Primary Examiner*—Hai Pham
*Assistant Examiner*—Lam S Nguyen
(74) *Attorney, Agent, or Firm*—Hogan & Hartson, LLP

(57) ABSTRACT

A method of controlling an ink jet recording apparatus ensures safety in replacing main tanks or the like and at the same time enables stable supply of ink from main tanks to sub-tanks. The apparatus includes a main tank having an information storage section and accommodated in a pressure tank, a sub-tank communicating with an ink jet head for storing ink, a tank-accommodating block for accommodating the main tank, and a control section capable of storing ink information. Valve control is performed in response to respective signals indicative of an ink shortage condition and an ink fill-up condition of the sub-tank, to thereby supply ink to the sub-tank. During operation of the apparatus, in response to a signal indication of opening of a door of the tank-accommodating block, the driving of a pressure source for pressurizing the pressure tank is stopped and the inside of the pressure tank is opened to the atmosphere. At the same time, ink information stored in the control section is written into the storage section of the main tank.

12 Claims, 18 Drawing Sheets

METHOD OF CONTROLLING INK JET RECORDING APPARATUS

BACKGROUND OF THE INVENTION

1. Field of the Invention

This invention relates to a method of controlling an ink jet recording apparatus that supplies ink from main tanks storing ink to ink jet heads through sub-tanks.

2. Prior Art

Conventionally, in a relatively large-sized ink jet recording apparatus, such as an ink jet printer, a main tank for storing ink and an ink jet head are connected to each other through an ink tube such that ink is supplied from the main tank to the ink jet head by suction action caused by operation of the ink jet head.

The ink jet recording apparatus of this kind suffers from a problem that it is difficult to maintain stable ejecting performance of the ink jet head due to changes in water head pressure since the ink level in the ink tank depends on the amount of ink stored in the ink tank. Further, to prevent ink from dripping from the ink jet head, it is necessary to arrange the ink jet head at a location slightly higher than the ink tank. However, it is not always possible to properly arrange a large-sized ink tank within a limited space in the ink jet recording apparatus.

To overcome the above problems, so as to increase the degree of freedom of arrangement of the ink tank, it is contemplated that a sub tank is interposed between the ink tank (main tank) and the ink jet head to secure the above water head pressure by using the sub tank. Further, it is preferred that the sub-tank is a bag-like one formed by a vapor deposited film or the like so as to prevent air from being mixed in the ink.

However, in the case of the ink jet recording apparatus which uses the sub-tank as described above, it is preferable to employ a pressure tank since pressure variation is undesirable for ink supply from the main tank to the sub-tank. In the case of the use of the pressure tank, when it is necessary to make the pressure tank open to the atmosphere e.g. because of abnormal stoppage of the apparatus or for replacement of the main tank, safety must be ensured. Further, since ink ejected from the ink jet head is supplied from the sub-tank, it is necessary to realize stable supply of ink from the main tank to the sub-tank.

SUMMARY OF THE INVENTION

It is an object of the invention to provide a method of controlling an ink jet recording apparatus, which ensures safety in replacing main tanks or the like and at the same time enables stable supply of ink from main tanks to sub-tanks.

To attain the above object, according to a first aspect of the invention, there is provided a method of controlling an ink jet recording apparatus including a main tank having an information storage section for storing an ink amount and ink attributes as ink information and replaceably received in a pressure tank, a sub-tank communicating with an ink jet head and storing ink sent from the main tank by pressure in the pressure tank, a tank-accommodating block for accommodating the main tank together with the pressure tank, and a control section capable of storing the ink information to be stored in the main tank. The ink jet recording apparatus supplies the ink in the main tank to the sub-tank by opening and closing a valve arranged on a upstream side of the sub-tank in response to a signal indicative of an ink fill-up/shortage condition of the sub-tank. The method comprise the step of stopping operation of a pressure source for pressurizing the pressure tank and at the same time making an inside of the pressure tank open to the atmosphere as well as writing an item of the ink information concerning the ink amount of the main tank stored in the control section into the information storage section of the main tank, in response to a signal indicative of opening of a door of the tank-accommodating block during operation of the apparatus.

According to this method, when the door of the tank-accommodating block is opened in response to the signal indicative of opening of the door, the operation of the pressure source for pressurizing the pressure tank is stopped, and the inside of the pressure tank is made open to the atmosphere. This enables makes it possible to instantly reduce pressure in the pressure tank. More specifically, if an operator (user) erroneously opens the door without carrying out operation of making the pressure tank open to the atmosphere, the pressure in the pressure tank can be reduced before it is made open to the atmosphere. This makes it possible to reliably prevent the user from erroneously opening the pressure tank under high pressure. Further, when the door is opened, ink information concerning the ink amount of the main tank stored in the control section is written in the information storage section of the main tank, so that it is possible to prevent any missing of the ink information from occurring, and at the same time confirm the identity of the main tank when the door is closed again.

Preferably, the method further comprises the step of closing the valve arranged on the upstream side of the sub-tank in response to the signal indicative of opening of the door of the tank-accommodating block during operation of the apparatus.

According to this preferred embodiment, even if ink is being supplied through an ink supply passage when the door of the tank-accommodating block is opened, the ink supply passage is blocked by closing the valve. Therefore, it is possible to positively stop the ink supply. Further, since the ink supply is carried out after the ink information is stored in the information storage section of the main tank, it is possible to prevent generation of an error between the information stored in the information storage section of the main tank and the information stored in the control section.

Preferably, the method further comprises the step of stopping cleaning operation of sucking ink from the ink jet head in response to the signal indicative of opening of the door of the tank-accommodating block during operation of the apparatus.

According to this preferred embodiment, even if the cleaning operation is being carried out by sucking ink from the ink jet head, when the door of the tank-accommodating block is opened, and an ink supply passage from the sub-tank to the ink jet head is not placed in a negative pressure state by the cleaning operation, which contributes to prevention of reverse flow of ink caused by the ink supply passage being in the negative pressure state upon termination of the cleaning operation. This makes it possible to prevent the ink jet head from being contaminated by ink which has once flown out of the ink jet head by suction. Further, although there is a case in which ink is replenished during cleaning operation, it is possible to prevent an error from being produced between the ink information stored in the information storage section of the main tank when the door is opened and the ink information stored in the control section, by inhibiting the cleaning operation when the door is opened.

Further, when the ink jet head includes a plurality of nozzle arrays for different ink colors, it is possible to prevent reverse flow of ink caused by cleaning operation continued with the door of the tank-accommodating block open, thereby effectively preventing the inside of the ink jet head from being contaminated by a mixture of different colors of inks.

Preferably, the method further comprises the steps of starting operation of the pressure source for pressurizing the pressure tank in response to a signal indicative of closing of the door of the tank-accommodating block during operation of the apparatus, when an item of the ink information concerning the ink attributes stored in the information storage section of the main tank and an item of the ink information concerning the ink attributes read out from the control section agree with each other, and at the same time when ink end information indicative of an ink-used-up condition is not contained in the item of the ink information concerning the ink amount stored in the information storage section of the main tank, and executing error notification in response to the signal indicative of closing the door of the tank-accommodating block during operation of the apparatus, when the item of the ink information concerning the ink attributes stored in the information storage section of the main tank and the item of the ink information concerning the ink attributes read out from the control section are different from each other, or when the ink end information is contained in the item of the ink information concerning the ink amount stored in the information storage section of the main tank.

According to this preferred embodiment, if the ink information concerning the ink attributes stored in the information storage section of the main tank, and that read out from the control section agree with each other, even if the ink information concerning the ink amount stored in the information storage section of the main tank, and that read out from the control section do not agree with each other, ink supply is permitted, and hence the operation of the pressure source for pressurizing the pressure tank is started. However, if the ink information concerning the ink amount stored in the storage section of the main tank contains ink end information indicative of an ink-used-up condition of the main tank, it is judged that the main tank is empty (e.g. a case of a main tank being replaced by an empty main tank), and hence ink supply cannot be executed, and accordingly the operation of the pressure source is not started.

On the other hand, if the ink information concerning the ink attributes stored in the information storage section of the main tank, and that read out from the control section do not agree with each other, that is, for instance, if the two items of ink information are different from each other in ink color or ink quality (e.g. between pigment ink and dye ink), it is likely to cause some trouble in carrying out printing operation, and therefore, the error notification is executed. Similarly, if the ink end information is contained in the ink information stored in the main tank, error notification is executed since it is necessary to replace the main tank. This makes it possible to effectively prevent the main tank from being erroneously and improperly replaced.

Preferably, the ink end information is a predetermined value of the ink amount exceeding a capacity of the main tank.

According to this preferred embodiment, it is possible to reduce a memory area in the information storage section of the main tank as well as to facilitate control operations (determination of an ink end) in the control section.

Preferably, the ink jet head, the sub-tank, and the main tank comprise a plurality of ink jet heads, a plurality of sub-tanks, and a plurality of main tanks, provided for different ink colors, and the method further comprises the steps of starting ink supply on a sub-tank-by-sub-tank basis in response to a signal indicative of detection of shortage of ink in the sub-tank, and stopping the ink supply in response to a signal indicative of detection of a fill-up of ink in the sub-tank on a sub-tank-by-sub-tank basis.

According to this preferred embodiment, ink supply from the main tank is controlled in response to the signal indicative of detection of shortage of ink in a sub-tank and the signal indicative of detection of a fill-up of ink in the sub-tank. This makes it possible to realize stable supply of ink from the ink tank to the sub-tank in dependence on the amount of ink stored in the sub-tank. Further, since ink is supplied based on the signal indicative of detection of shortage of ink in the sub-tank and the signal indicative of detection of a fill-up of ink in the sub-tank detected on a sub-tank-by-sub-tank basis, the amount of ink supply by one operation can be made uniform on a sub-tank-by-sub-tank basis.

Preferably, the ink jet head, the sub-tank, and the main tank comprise a plurality of ink jet heads, a plurality of sub-tanks, and a plurality of main tanks, provided for different ink colors, and the method further comprises the steps of starting ink supply to the sub-tanks in response to a signal indicative of detection of shortage of ink of at least one of the plurality of sub-tanks, and stopping the ink supply in response to a signal indicative of detection of a fill-up of ink, on a sub-tank-by-sub-tank basis.

According to this preferred embodiment, since ink is supplied in response to the signal indicative of shortage of ink in the sub-tank, it is possible to stably supply ink to the sub-tank in dependence on the amount of ink stored in the sub-tank. Further, if the signal indicative of shortage of ink is detected from any one of the plurality of sub-tanks, ink starts to be supplied to all the sub-tanks, so that the number of times and timing of supply of ink from the main tank can be made uniform between all the sub-tanks.

Preferably, the ink jet head, the sub-tank, and the main tank comprise a plurality of ink jet heads, a plurality of sub-tanks, and a plurality of main tanks, provided for different ink colors, and the method further comprises the steps of starting ink supply to all sub-tanks when at least one of signals each indicative of detection of a fill-up of a corresponding one of the plurality of sub-tanks is turned off, and stopping the ink supply in response to a signal indicative of detection of a fill-up of ink, on a sub-tank-by-sub-tank basis.

According to this preferred embodiment, if there is at least one of the plurality of sub-tanks of which a fill-up is not detected, ink starts to be supplied to all the sub-tanks, so that it is possible to perform stable ink supply such that all the sub-tanks are filled with ink as well as to make the number of times and timing of supply of ink from the main tank uniform between all the sub-tanks.

Preferably, the method further comprises the step of executing error notification when an actual replenishing time period from a start of the ink supply to each sub-tank to detection of a fill-up of ink therein exceeds an predetermined time period.

According to this preferred embodiment, by executing error notification when the actual replenishing time period exceeds a predetermined time period, the user can be notified that ink is not properly supplied due to an ink end (ink-used-up condition) of the main tank or a failure of the apparatus. Further, it is possible to prevent time from wastefully passing, when there has occurred leakage of ink, or the like.

Preferably, the step of executing error notification comprise the steps of stopping operation of the pressure source for pressurizing the pressure tank and making an inside of the pressure tank open to the atmosphere, and writing the item of the ink information concerning the ink amount of the main tank stored in the control section, into the information storage section of the main tank.

According to this preferred embodiment, when ink is not properly supplied due to a failure of the apparatus or the like, operation of the pressure source is stopped, the inside of the pressure tank is made open to the atmosphere to make pressure in the inside of the pressure tank equal to the atmospheric pressure, and ink supply from the main tank is stopped. This makes it possible to prevent improper ink supply from being continued. Further, ink information concerning the ink amount stored in the control section is stored in the information storage section of the main tank when operation of the pressure source is stopped, so that the information of the amount of ink stored in the main tank (amount of ink consumption) can be grasped accurately without causing any deficit in the ink information concerning the ink amount stored in the information storage section of the main tank.

To attain the above object, according to a second aspect of the invention, there is provided a method of controlling an ink jet recording apparatus including a main tank having an information storage section for storing ink information and replaceably received in a pressure tank, a sub-tank communicating with an ink jet head and storing the ink sent from the main tank by pressure in the pressure tank, a tank-accommodating block for accommodating the main tank together with the pressure tank, and a control section capable of storing ink information. In response to a signal indicative of an ink fill-up/shortage condition of the sub-tank, the ink jet recording apparatus supplies the ink in the main tank to the sub-tank by opening and closing a valve arranged on a upstream side of the sub-tank, and stores an amount of ink consumed by operation of the ink jet head, a number of times of ink replenishment to the sub-tank, an ink capacity of the main tank, in the control section, as the ink information. The method comprise the step of adding an amount of ink consumed through the sub-tank to an amount of ink consumed through the main tank when ink starts to be supplied to the sub-tank, and storing the resulting amount in the control section, and resetting the amount of ink consumed through the sub-tank.

According to this method, since the amount of ink consumed through the main tank is calculated as a cumulative total of amounts of ink consumed through the sub-tank, it is possible to consolidate calculations of the amounts of consumed ink. This makes it possible to simplify the construction of the control system without any need to provide a dedicated counter for the main tank. Further, even when ink is not properly replenished from the main tank to the sub-tank due to some failure (e.g. leakage of ink), the amount of ink consumed through the main tank and the amount of ink consumed through the sub-tank do not become different from each other. Further, the amount of ink consumed through the sub-tank (amount of remaining ink therein) can be always grasped separately from the amount of ink consumed through the main tank.

Preferably, the method further comprises the steps of counting the number of times of ink replenishment to the sub-tank for storage in the control section when ink starts to be supplied to the sub-tank, and resetting the number of times of ink replenishment to the sub-tank stored in the control section when the sub-tank is replaced.

According to this preferred embodiment, it is possible to grasp the number of times of ink replenishment to the sub-tank which undergoes wear and tear (material fatigue and degradation) by repeated ink replenishment from the main tank. This makes it possible to estimate the remaining service life of the sub-tank based on the number of times of ink replenishment, and carry out maintenance of the sub-tank based on proper timing of replacement.

Preferably, the method further comprises the step of writing the amount of ink consumed through the main tank into the information storage section of the main tank when there has occurred abnormal stoppage of the system, when a door of the tank-accommodating block is opened during operation of the apparatus, when an initial ink-filling process for filling ink in the sub-tank is carried out, or when the ink in the main tank is used up.

According to this preferred embodiment, the amount of ink consumed through the main tank is written when work or operation concerning the main tank is expected to be carried out, e.g. when there has occurred abnormal stoppage of the apparatus, or when a door of the tank-accommodating block is opened during operation of the apparatus. Therefore, even if such operation is carried out, no deficit is caused in information concerning the amount of consumed ink which is stored in the information storage section of the main tank.

Preferably, the method further comprises the step of writing a specific ink amount value exceeding a capacity of the main tank into the information storage section of the main tank, when the ink in the main tank is used up.

According to this preferred embodiment, once a main tank comes to an ink end (used-up) condition, it can be determined as such based on the specific ink amount value written into the information storage section thereof. Therefore, even if an empty main tank is set for use by mistake, error notification is carried out immediately, so that it is possible to cope with such a state without delay.

The above and other objects, features, and advantages of the invention will become more apparent from the following detailed description taken in conjunction with the accompanying drawings.

BRIEF DESCRIPTION OF THE DRAWINGS

The above and other objects and the attendant features of this invention will become readily apparent by reference to the following detailed description when considered in conjunction with the accompanying drawings wherein:

FIGS. 6A to 6C are diagrams of an ink cartridge, in which FIG. 6A is an exploded perspective view of a cartridge casing, FIG. 6B is a perspective view of an ink tank, and FIG. 6C is a front view of the cartridge casing;

FIGS. 8A and 8B are diagrams of the pressure tank, in which FIG. 8A is a perspective view of the pressure tank in an open state, and FIG. 8B is a side view of the pressure tank in the open state;

FIGS. 13A and 13B are diagrams of a storage unit and component parts associated therewith, in which FIG. 13A is perspective view of the storage unit and component parts associated therewith, and FIG. 13B is a plan view of the storage unit and component parts associated therewith;

FIGS. 14A and 14B are diagrams of a cleaning unit and a wiping unit, and component parts associated therewith, in which FIG. 14A is a perspective view of the cleaning unit and the wiping unit, and the component parts associated therewith, and FIG. 14B is a plan view of the cleaning unit and the wiping unit, and the component parts associated therewith;

DETAILED DESCRIPTION OF THE PREFERRED EMBODIMENT

The invention will now be described in detail with reference to the drawings showing an embodiment thereof. An ink jet printer according to the embodiment is a large-sized color printer for business use, which is connected to an external apparatus, such as a personal computer. The ink jet printer is capable of printing desired images by an ink jet method based on image data formed by the external apparatus. More specifically, the ink jet printer is capable of continuously printing a large number of unit images on a printing tape as a continuous paper such that portions of the tape printed with the unit images can be cut out afterwards for use as labels, and hence, for instance, it is possible to perform small-lot printing for producing labels to be affixed to wrapping films for wrapping perishable food by using the printer.

Figure 1:
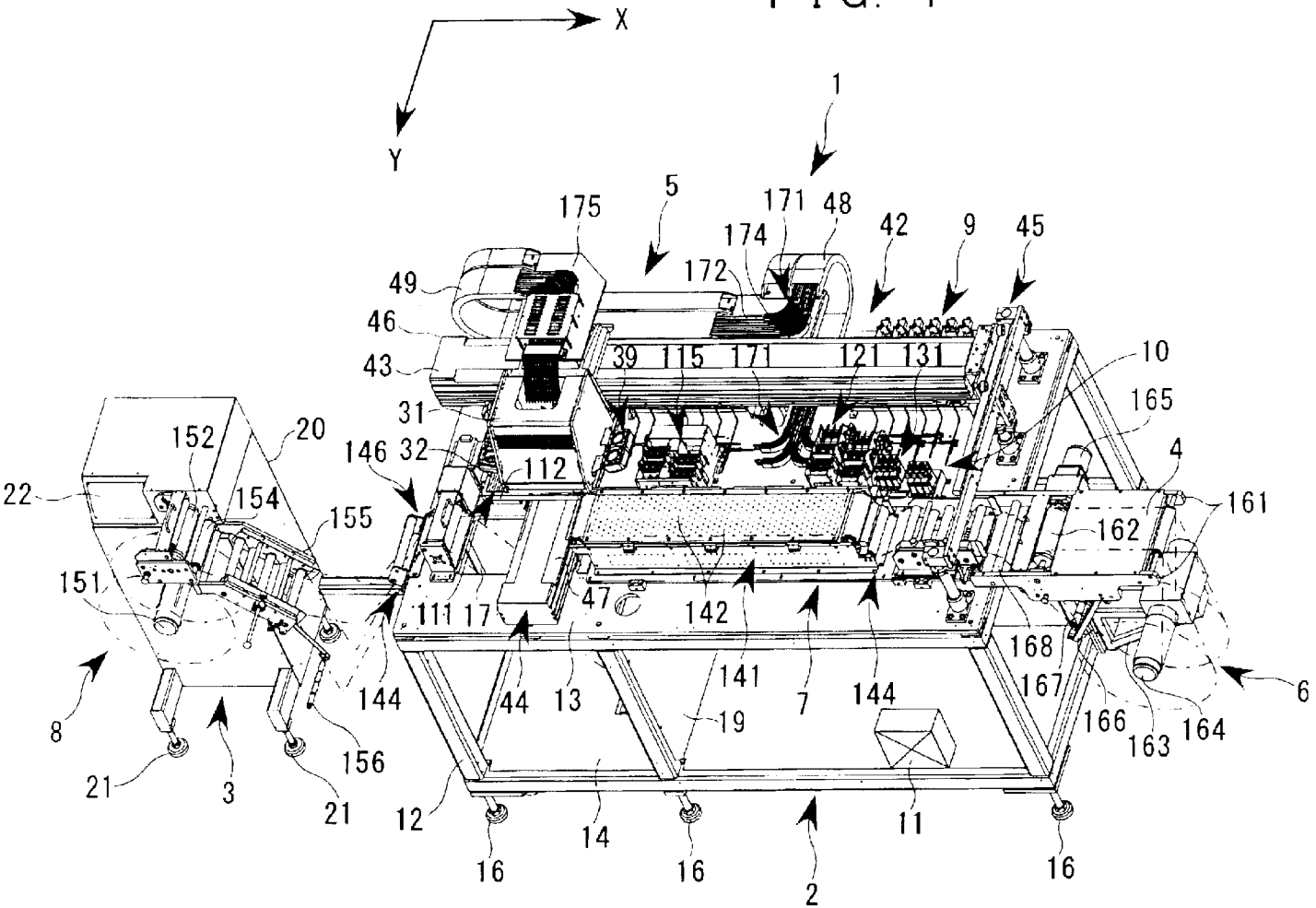
FIG. 1 is a perspective view of the appearance of an ink jet printer according to an embodiment of the invention.
Figure 2:
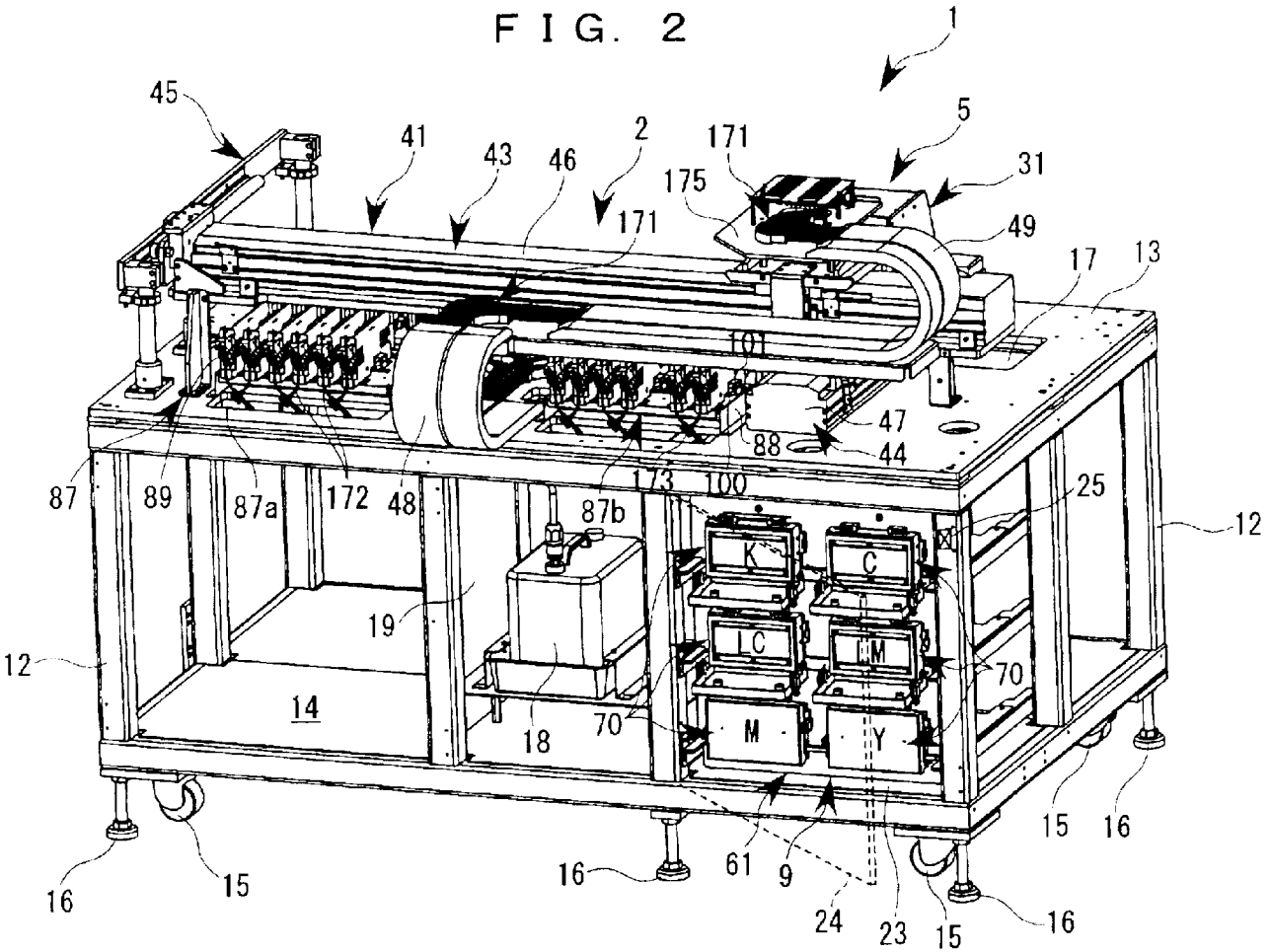
FIG. 2 is a perspective view of the appearance of the ink jet printer with part thereof omitted from illustration, as viewed from the rear side.

FIG. 1 is a perspective view of the appearance of the whole ink jet printer. FIG. 2 is a perspective view of the appearance of the ink jet printer with part thereof omitted from illustration, as viewed from the rear side.

As shown in FIG. 1, this ink jet printer 1 is constructed by connecting a small-sized finisher to a large-sized base 2, and includes, on the side of the base 2, a printing means 5 installed on the base 2 for carrying out printing on a printing tape A, a tape supply means 6 for supplying the printing tape A by unwinding a roll thereof mounted on the base 2 in a manner overhanging rightward therefrom, and a tape feeding means 7 for feeding the printing tape A supplied along a tape feeding path 4 longitudinally extending across the base 2, and incorporates, on the side of the finisher 3, a tape take-up means 8 for taking up printed part of the printing tape A which is received from the tape feeding means 7, into a roll.

Further, on the base 2, there are arranged an ink supply means 9 for supplying ink to a head unit 31 (ink jet heads 34) of the printing means 5, a maintenance means 10 for maintenance of the ink jet heads 34, and a controller 11 (control means) for controlling these essential components individually and at the same time in a manner correlated with each other.

The ink jet printer 1 sucks the printing tape A unwound from the roll thereof to place it into a horizontal position by using a suction table 141 of the tape feeding means 7, causes the printing means 5 to continuously print a large number of images on the printing tape A in this state while sending out the printed part of the printing tape A from the suction table 141 whenever necessary to continue subsequent printing, and finally causes the tape take-up means 8 to take up the printing tape A printed with images. The printing tape A is a so-called continuous form backed with release paper. As the printing tape A, there are provided a plurality of (eleven) kinds of printing tapes which vary in tape width from minimum 50 mm to maximum 150 mm at a pitch of 10 mm.

It should be noted that inks for the printing, i.e. inks used for carrying out one line of color printing are of six basic colors in total, i.e. cyan (C), magenta (M), yellow (Y), and black (K), and additional colors of light cyan (LC) and light magenta (LM). The inks of these six colors are supplied to the ink jet heads 34 (head unit 31) through respective intermediate ink packs 89 as sub-tanks (see FIG. 2, etc.).

The base 2 is formed by assembling angle bars 12 into a base support having a rectangular parallelepiped shape and rigidly fixing a base plate 13 to the top of the base support and a shelf 14 to a lower portion thereof. Four casters 15, and six support legs 16 with adjustment bolts are attached to the bottom of the shelf 14. On the base plate 13, there are arranged, in addition to the printing means 5, the maintenance means 10 at a center thereof, the sub-tanks of the ink supply means 9 at a rear thereof, and a main part of the tape feeding means 7 at a front thereof. Further, the tape supply means 6 is mounted at one longitudinal end of the base plate 13 through one of the angle bars 12 at an intermediate location in the front-rear direction.

The base plate 13 has approximately square-shaped openings in front portions (two portions) toward the tape take-up means 8. The tape feeding path 4 largely detours downward such that it extends between the base plate 13 and the shelf 14 from one opening 17 to the other 17. Further, main components (tanks) of the ink supply means 9 and a large-sized waste ink tank 18 for storing useless waste ink collected after use in maintenance operation are arranged on a rear portion of the shelf 14. Further, the controller 11 is arranged between the base plate 13 and the shelf 14 at a front location on a right side of a partition plate 19.

It should be noted that on the base plate 13 of the base 2, there is provided a safety cover, not shown, covering the above means and component parts arranged as described above. In front of a main tank unit-accommodating block 23 (tank-accommodating block), a maintenance door 24 (door of the tank-accommodating block), and a sensor 25 is attached to one of the angle bars 12 for detecting closing of the maintenance door 24. The sensor 25 is connected to the controller 11, for always monitoring the closing and opening of the maintenance door 24 when the power supply to the printer 1 is ON. Further, the safety cover has an alarm lamp section, not shown, arranged on the top thereof. The alarm lamp section has an operation indicator lamp for indicating that the apparatus is in printing operation, remaining ink amount indicator lamps for indicating the amounts of ink remaining in ink cartridges, a tape indicator lamp for indicating a tape end (used-up condition of the printing tape A), and so forth.

The finisher 3 is comprised of a finisher body 20, and four support legs 21 with adjustment bolts, attached to the bottom of the finisher body 20. The finisher body 20 has the tape take-up means 8 arranged therein. The finisher body 20 also has an operation panel 22 arranged on an upper left-hand portion of a front surface thereof, which is operated e.g. for adjusting torque for taking up the printing tape A. It should be noted that the main power of the ink jet printer 1 can be turned on only when the finisher 3 and the base 2 are connected to each other.

Figure 3:
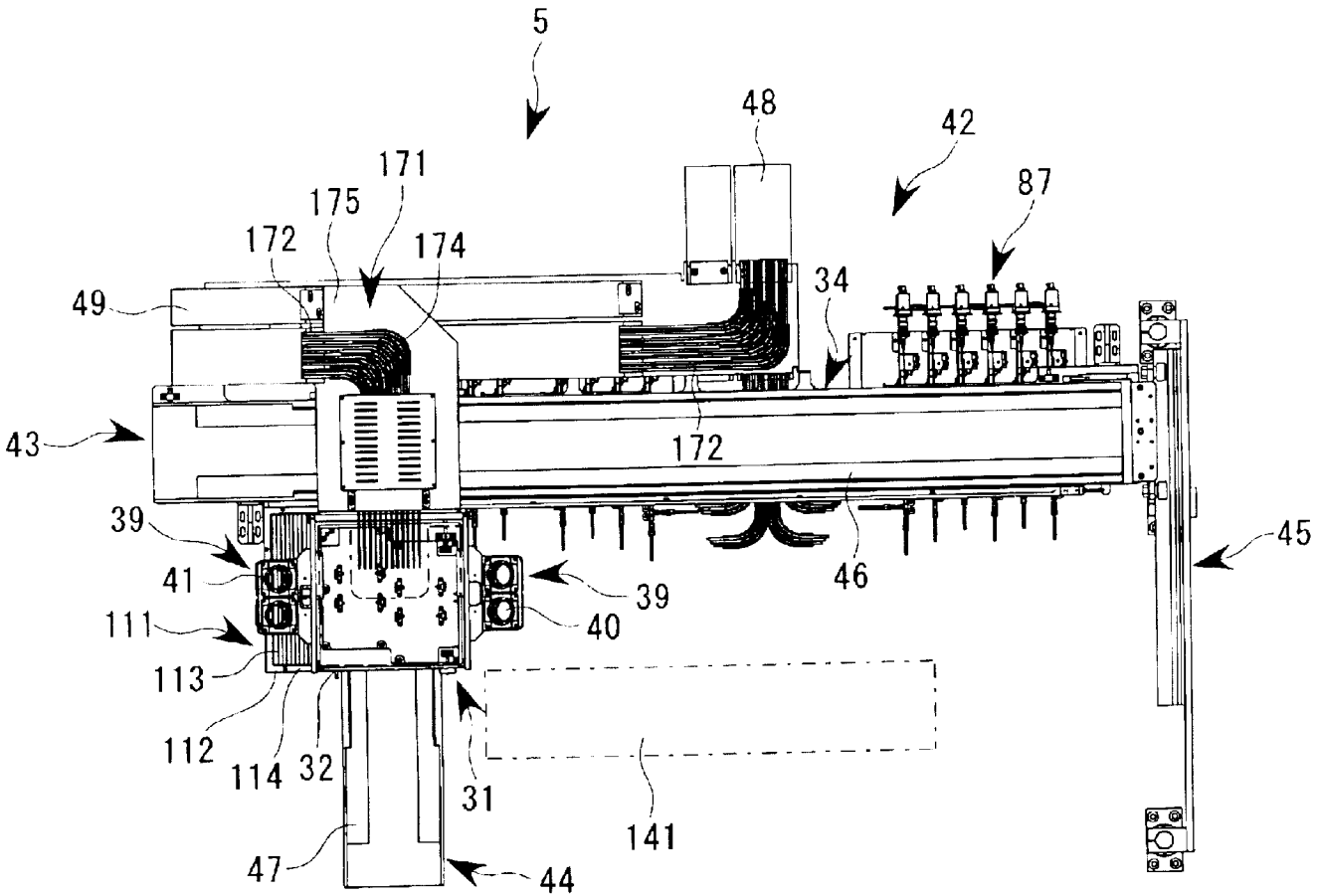
FIG. 3 is a plan view of a printing means and component parts associated therewith.
Figure 4:
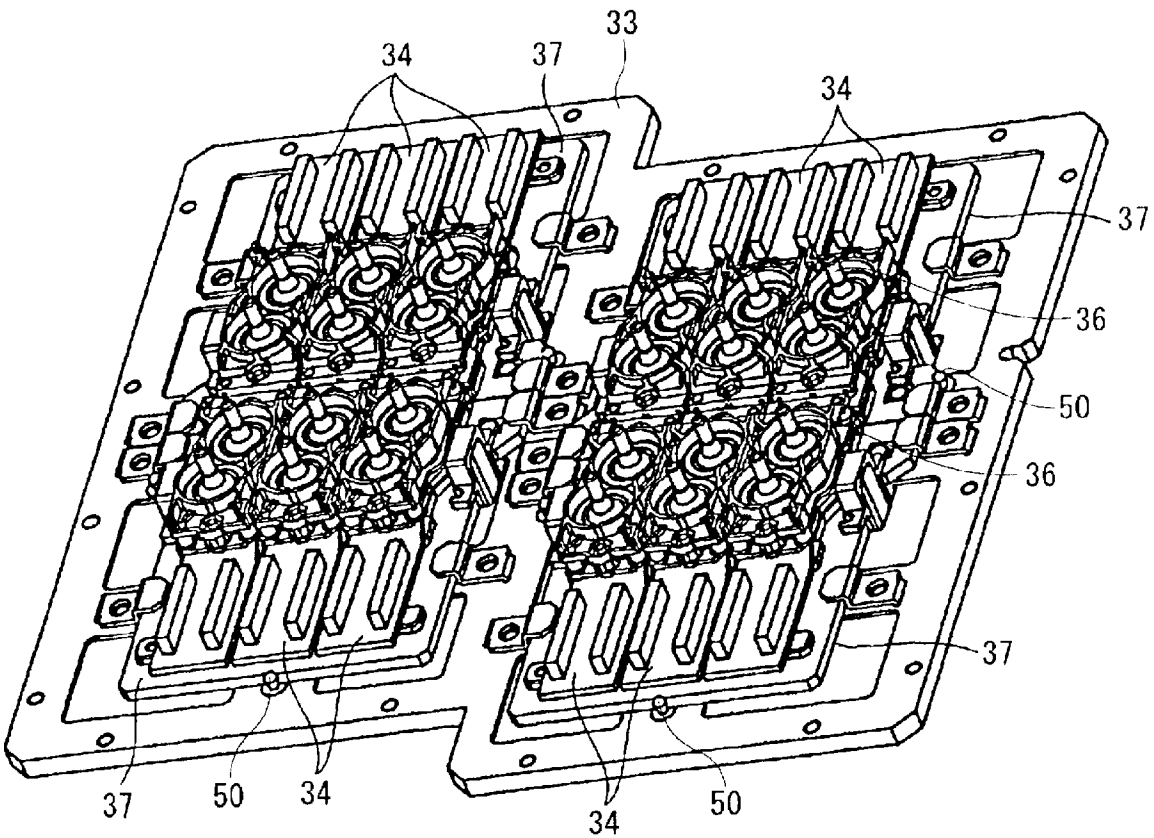
FIG. 4 is a perspective view of the appearance of a head unit.

Next, the means of the ink jet printer 1 will be described one by one in detail. As shown in FIGS. 3 and 4, the printing means 5 includes the head unit (ink jet head unit) 31 including a large number of ink jet heads 34, and an X-Y moving mechanism 42 for moving the head unit 31 in main and sub scanning directions, as desired.

The head unit 31 includes a support bracket 32 having a female screw block attached to a rear surface thereof, a unitizing carriage 33 (see FIGS. 3 and 4) horizontally attached to the bottom of the support bracket 32, a paper powder-removing mechanism 39 comprised of a plurality of paper powder-removing fans 40, 41 attached to the left-hand side and the right-hand side of the support bracket 32. The unitizing carriage 33 has a plurality of ink jet heads 34 mounted thereon, each of which is formed with a large number of ink nozzles (ink nozzle array) in an underside surface thereof.

More specifically, the unitizing carriage 33 has four sub-carriages 37 removably mounted thereon. Each of the sub-carriages 37 has a row of three ink jet heads 34 mounted thereon. In other words, twelve ink jet heads 34 in total are mounted on the four sub-carriages 37.

The ink jet heads 34 are each rigidly fixed (bonded or screwed) to a corresponding one of the four sub-carriages 37, and the four sub-carriages 37 are removably mounted on the unitizing carriage 33 by positioning/mounting means 50 comprised of a plurality of pins (see FIG. 4). Further, the ink jet heads 34 mounted on each of the sub-carriages 37 have respective main bodies each formed with ink nozzles and projecting downward from the unitizing carriage 33. The ink jet heads 34 on one sub-carriage 37 are arranged in a manner such that the main bodies thereof are opposed to those of the ink jet heads 34 on another sub-carriage 37 adjacent to the one sub-carriage 37, whereby the ink nozzles are intensively disposed to form an ink nozzle array group 38 (see FIG. 5). The main body of each ink jet head 34 has a reverse side thereof formed with an ink supply block 36 to which ink tubes from the sub-tanks for the respective colors of inks are connected to supply the inks to the ink jet heads 34, on an as-needed basis.

Figure 5:
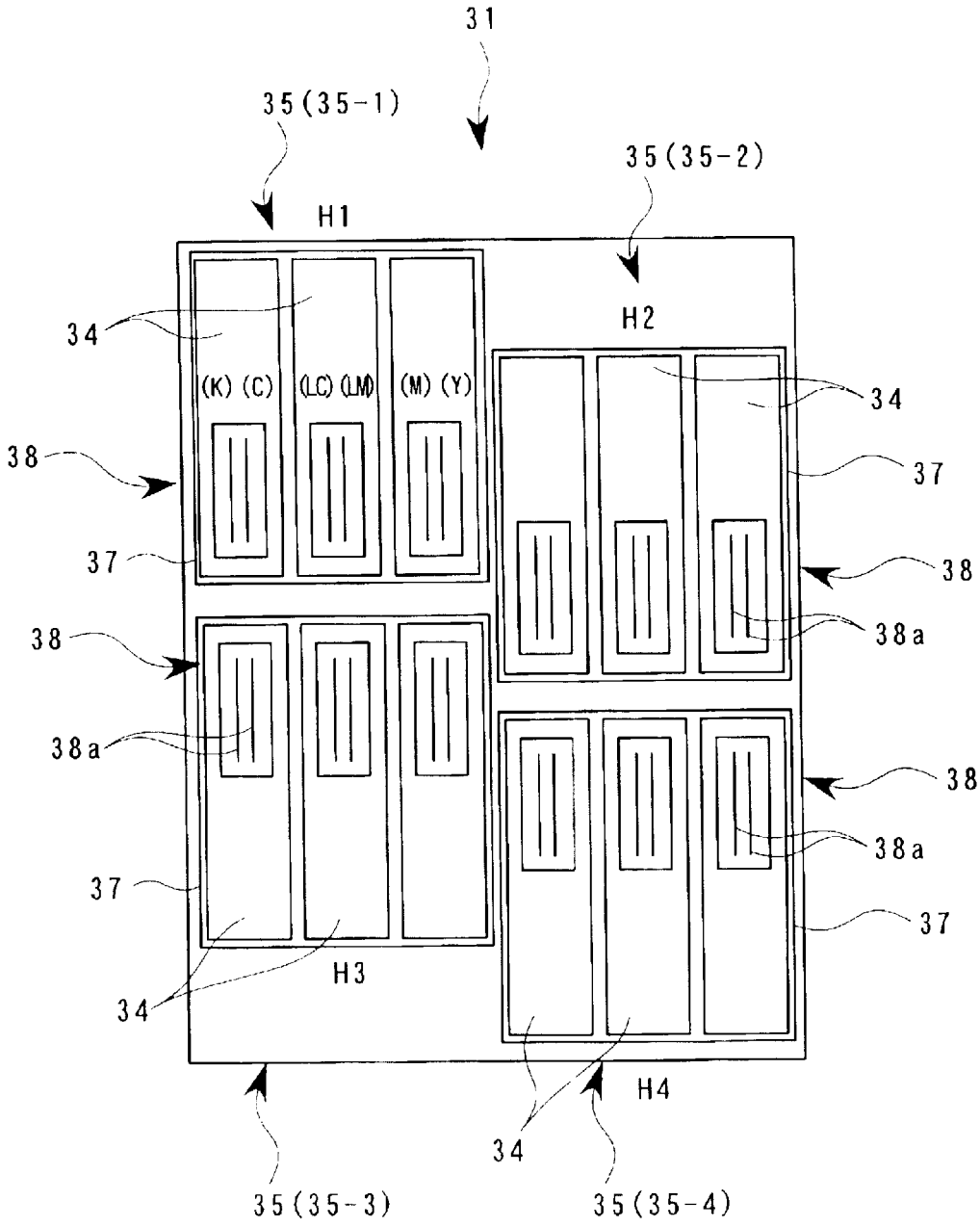
FIG. 5 is a block diagram schematically showing the arrangement of the head unit.

As schematically shown in FIG. 5, the ink nozzle array group 38 of ink nozzle arrays of the six colors employed as the basic colors for one line is divided into four divisional ink nozzle array groups 38*a*, and the divisional ink nozzle array groups 38*a* each including ink nozzle arrays of the six colors are mounted on the sub-carriages 37, respectively, in a state incorporated in the three ink jet heads 34. More specifically, a first head 35-1 of the three ink jet heads 34 mounted on each of the sub-carriages 37 incorporates two divisional ink nozzle arrays 38*a* of black (K) and cyan (C) colors, a second head 35-2 incorporates two divisional ink nozzle arrays 38*a* of light cyan (LC) and light magenta (LM) colors, and a third head 35-3 incorporates two divisional ink nozzle arrays 38*a* of magenta (M) and yellow (Y) colors.

The divisional ink nozzle array groups 38*a* are arranged in a manner staggered from each other with portions (of the ink nozzles) partially overlapping each other, to form, as a whole, the ink nozzle array group 38 (for one line) which has a length of approximately four inches.

Referring to FIG. 3, the X-Y moving mechanism 42 is a so-called X-Y robot installed on the base plate 13, and comprised of an X-axis table 43 for moving the head unit 31 in an X-axis direction (main scanning direction, direction of the length of the printing tape A), a Y-axis table 44 for moving the X-axis table 43 in a Y-axis direction (sub scanning direction, direction of the width of the printing tape A), and a Y-axis guide 45 arranged in parallel with the Y-axis table 44 for guiding the motion of the X-axis table 43.

The X-axis table 43 accommodates a main scanning ball screw, not shown, for reciprocating the head unit 31 in the main scanning direction, and a main scanning motor, not shown, for driving the main scanning ball screw for normal or reverse rotation within an X-axis table frame 46 forming an outer shell of the X-axis table 43. The Y-axis table 44 accommodates a sub scanning ball screw, not shown, for reciprocating the X-axis table frame 46 in the sub scanning direction, and a sub scanning motor, not shown, for driving the sub scanning ball screw for normal or reverse rotation within a Y-axis table frame 47 forming an outer shell of the Y-axis table 44.

The main scanning motor and the sub scanning motor are connected to the controller 11 described above. The controller 11 drives the main scanning motor for normal or reverse rotation to thereby reciprocate the head unit 31 in the main scanning direction, and drives the sub scanning motor for normal or reverse rotation to thereby move the head unit 31 through the X-axis table 43 for printing one line. The head unit 31 is moved to the next line in accordance with the motion of the X-axis table 43 in the sub scanning direction.

The X-Y moving mechanism 42 includes an X direction-detecting sensor, not shown, for detecting a reference position (home position, at a left-hand location as viewed in FIG. 3: origin of the X axis) of the head unit 31 in the X-axis direction, and a Y direction-detecting sensor, not shown, for detecting a reference position of the head unit 31 in the Y-axis direction through the X-axis table 43. The X-Y moving mechanism 42 is configured to be always reset to the reference position when the main power of the ink jet printer 1 is turned on.

Next, the ink supply means 9 will be described with reference to FIG. 2. The ink supply means 9 includes a main tank unit 61 arranged on the shelf 14, for storing large amounts of inks of the six colors, a sub-tank unit 87 arranged on the base plate 13, for supplying the inks delivered from the main tank unit 61 to the ink jet heads 34, and a tube unit 171 for connecting the main tank unit 61, the sub-tank unit 87, and the ink jet heads 34. The main tank unit 61 is arranged at a location lower than the sub-tank unit 87, and the sub-tank unit 87 is arranged at a location slightly lower than the ink jet heads 34 so as to prevent the inks from dripping.

The main tank unit 61 supplies inks under pressure to the sub-tank unit 87. The inks stored in the sub-tank unit 87 are supplied to the ink jet heads 34 by pumping action (caused by ejection of ink droplets) of the ink jet heads 34. More specifically, each pressurized ink supplied from the main tank unit 61 is supplied to the ink jet heads 34 in the state having the supply of pressure to the ink cut off by the sub-tank unit 87.

Before describing details of the units of the ink supply means 9, first, a whole ink supply system will be described with reference to FIG. 9. So as to be adapted to the four head groups 35 in each of which the divisional ink nozzle arrays 38*a* of the six colors (K, C, LC, LM, M, and Y) are distributed in the three ink jet heads 34 thereof arranged in a row, that is, so as to be adapted to the twenty-four ink nozzle arrays forming the twelve ink jet heads 34 in total, the main tank unit 61 includes one ink cartridge 62 for each color of ink (i.e. six ink cartridges 62 in total), and the sub-tank unit 87 includes two intermediate ink packs 89 for each color of ink (i.e. twelve intermediate ink packs 89 in total).

The system of ink supply of the present apparatus is configured such that the flow of each of the inks of the six colors from the ink cartridges 62 is bifurcated two times by the tube unit 171 so as to be supplied to the twenty-four ink nozzle arrays. This makes it possible to reduce the number of ink cartridges 62 for the plurality of ink jet heads 34 (ink nozzle arrays), thereby increasing the degree of freedom of arrangement of the ink cartridges 62. Further, proper arrangement of the tube unit 171 makes it possible to minimize pressure losses produced in ink supply passages leading to the ink jet heads 34.

Now, the main tank unit 61 will be described with reference to FIGS. 2 and 9. The main tank unit 61 is comprised of the ink cartridges 62, pressure tanks 70 for removably containing the ink cartridges 62, and an air supply mechanism 81 as a pressure source for supplying pressurized air to the pressure tanks 70. The ink cartridges 62 and the pressure tanks 70 are received in the tank-accommodating block 23. There are provided a plurality of (six) ink cartridges 62 and a plurality of (six) pressure tanks 70 for the respective inks of the six colors, while the air supply mechanism 81 is formed by a single mechanism which applies pressure to inks in the ink cartridges 62 to thereby supply the inks under pressure to the sub-tank units 87, by the operation of a pressure pump 83, referred to hereinafter.

Figure 6A:
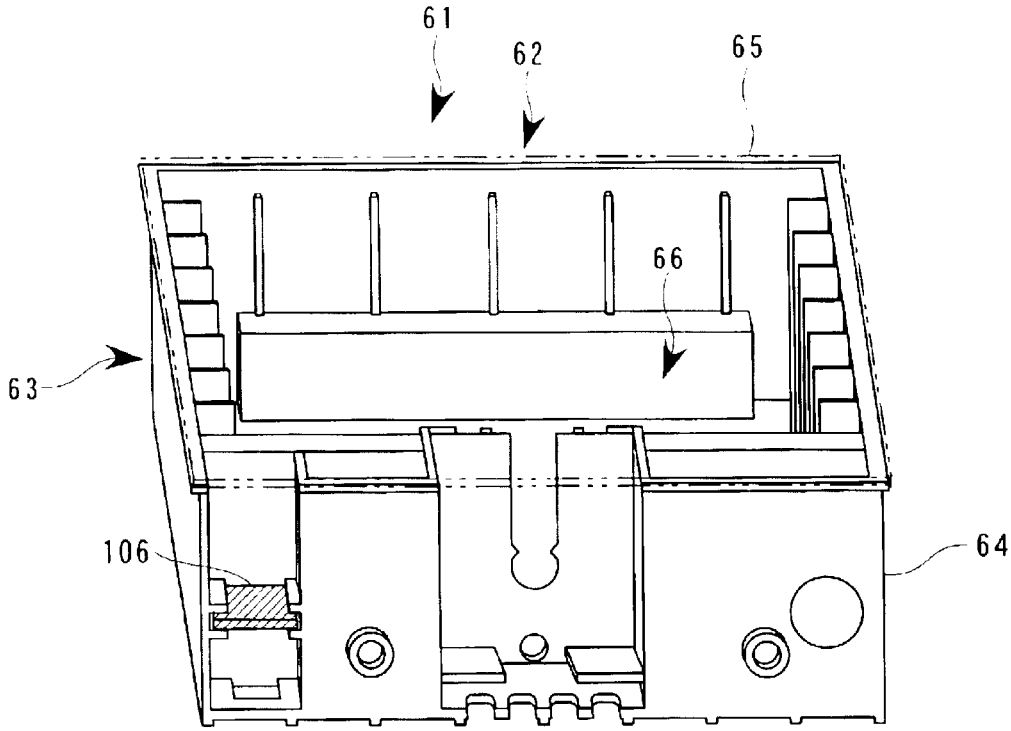
Figure 6B:
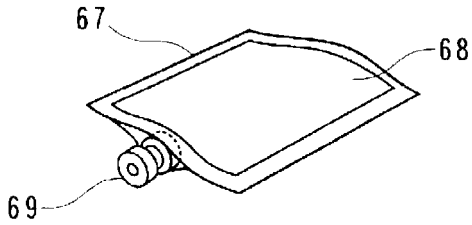
Figure 6C:
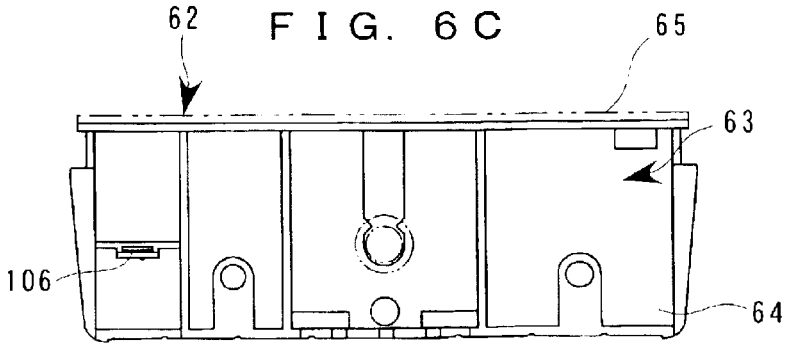

Referring to FIGS. 6A to 6C, each ink cartridge 62 is comprised of a resin cartridge casing 63 forming an outer shell of the cartridge 62, and an ink tank 67 received in the cartridge casing 63. The ink tank 67 is non-hermetically accommodated in the cartridge casing 63. Each cartridge casing 63 is configured to be exclusively used for one ink color, and includes an IC chip 106 for storing the count of an ink cartridge consumption counter in each of the ink cartridges 62, which count (value) has been stored on an ink color-by-ink color basis or on an ink cartridge by-ink cartridge basis by a control section 188, referred to hereinafter, of the controller 11. The ink tank 67 has a main part thereof formed by a deformable and flexible bag-like pack body 68 and includes a resin ink supply port 69 attached to one end of the pack body 68. The inside of the cartridge casing 63 communicates with the inside of the pressure tank 70 accommodating the ink cartridge 62 such that pressure in an ink tank-accommodating space 66 defined within the cartridge casing 63 and pressure in the pressure tank 70 are always maintained equal to each other.

Figure 7:
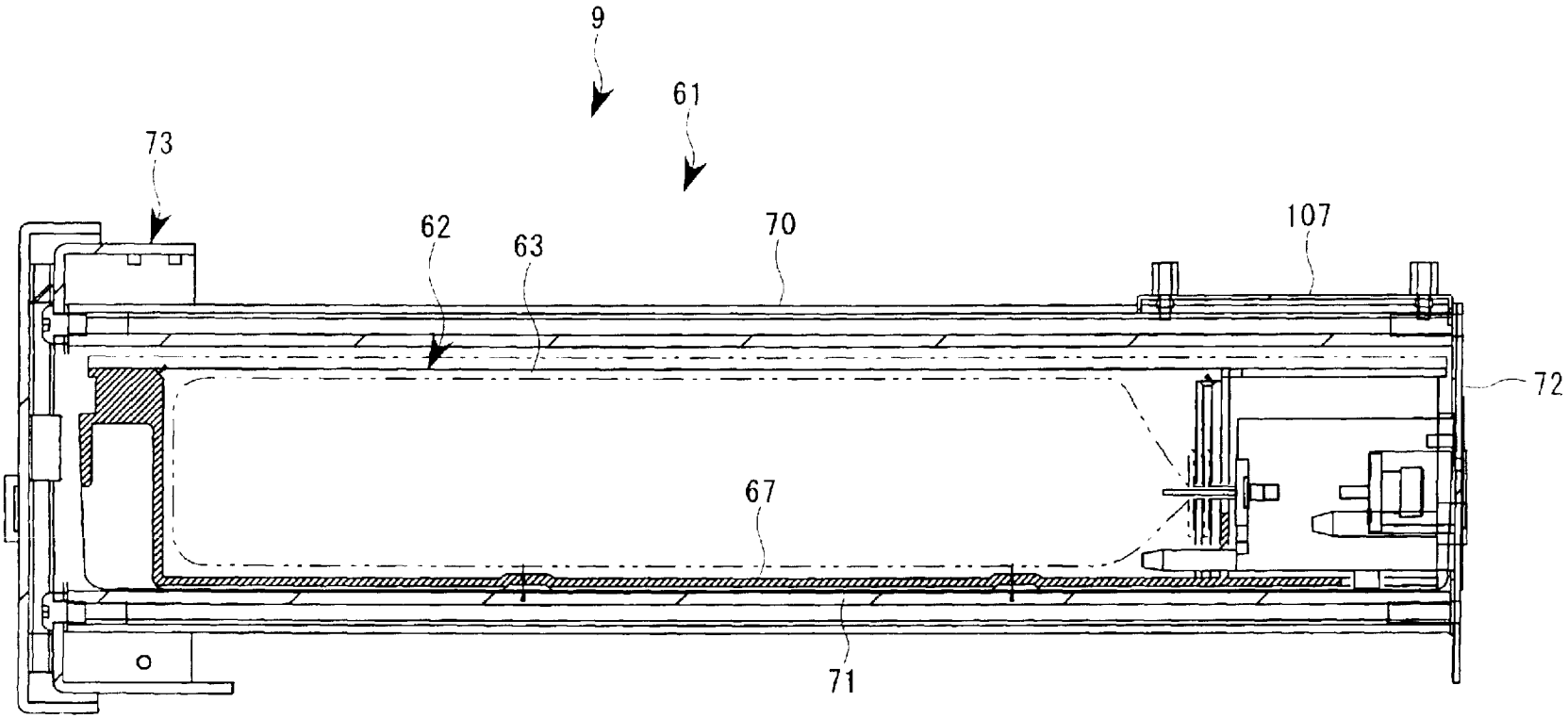
FIG. 7 is a cross-sectional view showing a pressure tank having the ink cartridge received therein.
Figure 8A:
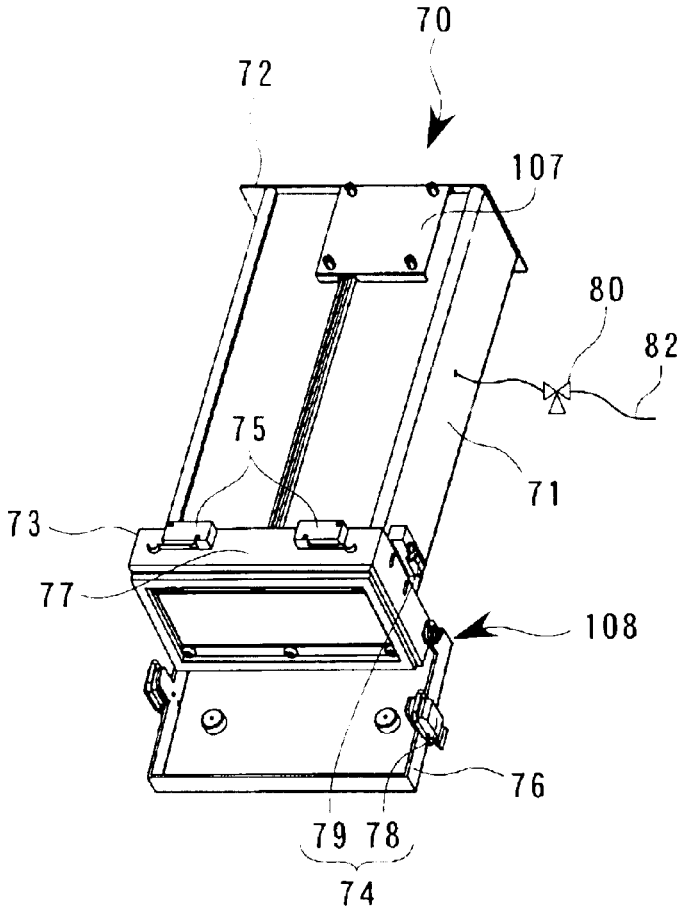
Figure 8B:
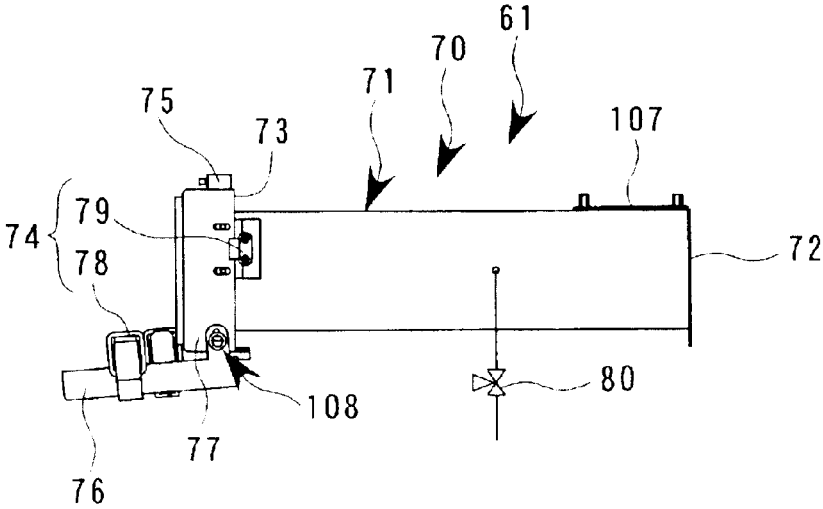

As shown in FIG. 2, the pressure tanks 70 are fixedly arranged on the shelf 14 in three stages and two columns, so that the pressure tanks 70 for the respective ink colors are laid out as shown in the figure. As shown in FIG. 7 and FIGS. 8A and 8B, each of the pressure tanks 70 is comprised of a hollow body 71 which is a main part thereof, a closing member 72 arranged on one end of the hollow body 71, and a lid member 73 arranged on the other end of the hollow body 71 such that a fully hermetic space can be formed inside the pressure tank 70. Further, the hollow body 71 is formed with a pair of front and rear convex portions for engagement with concave portions of the ink cartridge 62, at a transversely central location of the hollow body 71. The closing member 72 has a tank-side joint attached thereto at a transversely intermediate location thereof in a manner protruding into the inside of the hollow body 71. The tank-side joint is connected to the ink cartridge 62 mounted in the hollow body 71.

As shown FIGS. 8A and 8B, the lid member 73 is attached to the hollow body 71 such that the lid member 73 can be opened and closed, and that the end of the hollow body 71 on a front side thereof can be completely closed by the lid member 73. The lid member 73 is comprised of a lid support 77 in the form of a frame fixed to the hollow body 71, and a lid body 76 for opening and closing the smaller opening of the hollow body 71. The lid body 76 is opened about a hinge 108 arranged at a lower end of the lid support 77. Further, the lid member 73 includes a pair of fastening devices 74 for locking the lid member 73 in a closed state, and a detecting device 75 for detecting a state of the lid member 73 completely closed by the fastening devices 74. The pair of fastening devices 74 are each comprised of a latch 78 arranged on the lid body 76, and a catch 79 arranged on the lid support 77 for holding the latch 78 and are arranged at respective locations symmetric with respect to a center of the lid member 73. Due to this configuration, by establishing the locked state of the pair of fastening devices 74, the lid member 73 is brought into firm and intimate contact with the hollow body 71 of the pressure tank 70, thereby making it possible to ensure pressure-tightness of the pressure tank 70. Incidentally, the detecting device 75 is connected to the controller 11.

As described above, since the non-airtight ink cartridge 62 is accommodated in the completely airtight pressure tank 70 for pressurization, the cartridge casing 63 of the ink cartridge 62 can be simplified in construction to thereby enhance ease of handling of the ink cartridge 62. Further, so as to smoothly open the lid member 73 in the state of the ink cartridge 62 being accommodated in the pressure tank 70 for pressurization, air piping 82, referred to hereinafter, is attached to a side portion of each pressure tank 70, that is, to a right side portion, as viewed in the figure, of the hollow body 71 of the pressure tank 70, such that the air piping 82 communicates with the inside of the pressure tank 70, and an air release valve 80 is provided across a nearby portion of the air piping 82. The air release valve 80 is formed by a three-way valve, which receives pressurized air from the air supply mechanism 81, and when the pressure of the pressurized air becomes lower than a predetermined level, a valve element of the three-way valve is moved to make the inside of the pressure tank 70 open to the atmosphere.

Figure 9:
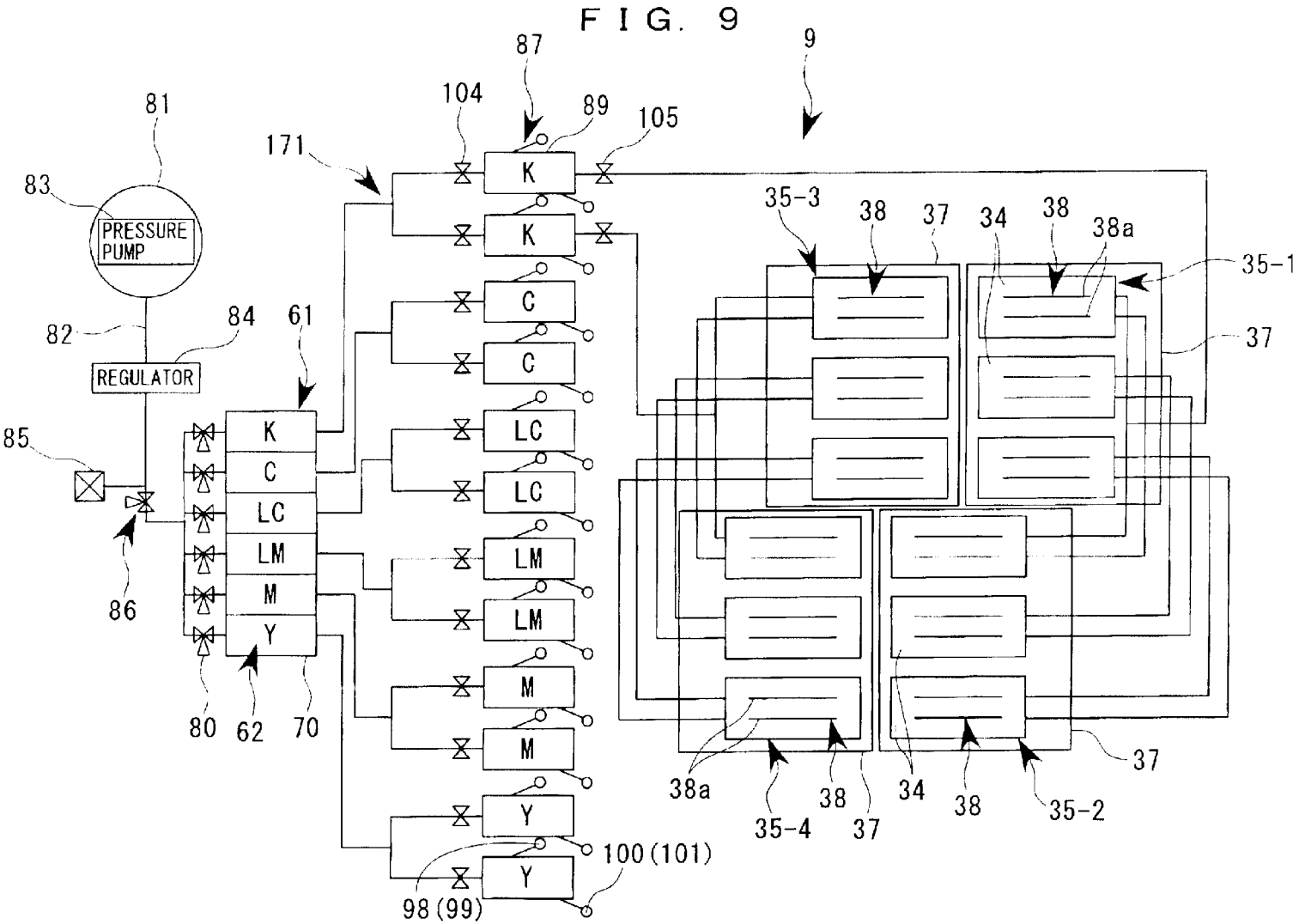
FIG. 9 is a schematic diagram of piping of an ink supply system.

As shown in FIG. 9, the air supply mechanism 81 exclusively provided for supply of inks is constructed by connecting the pressure tanks 70 thereto by the air piping 82. The air supply mechanism 81 includes the pressure pump 83 connected by the air piping 82 to the pressure tanks 70, for supplying pressurized air thereto, a regulator 84 arranged in the air piping 82 at a location between the pressure pump 83 and the pressure tanks 70, an air tank 85 for leveling pulsating flow generated in the air piping 82, and a switching valve 86 arranged in the air piping 82 at a location between the air tank 85 and the respective air release valves 80 of the pressure tanks 70.

The regulator 84 carries out feedback of detected pressure (pressure loading) for control of driving of the pressure pump 83 such that the pressure in the pressure tanks 70 is always held constant, to thereby keep the pressure in the ink cartridge 62 accommodated in each pressure tank 70 at the same level as the pressure in the pressure tank 70.

The switching valve 86 is formed by an electromagnetic valve (electromagnetic three-way valve), and connected to the controller 11. The switching valve 86 is normally held open such that air from the pressure pump 83 can be supplied to the pressure tanks 70, and in replacing the ink cartridge 62 with another, it is switched such that the insides of the respective pressure tanks 70 can be made open to the atmosphere. More specifically, when the switching valve 86 in the normal state is switched, air in the air piping 82 supplied from the air supply mechanism 81 to the air release valves 80 is released to the atmosphere. That is, the air release valves 80 are automatically switched to make the respective insides of the pressure tanks 70 open to the atmosphere. This makes it possible not only to supply suitable pressurized air to the pressure tanks 70 but also to easily make the insides of the respective pressure tanks 70 open to the atmosphere.

Figure 10:
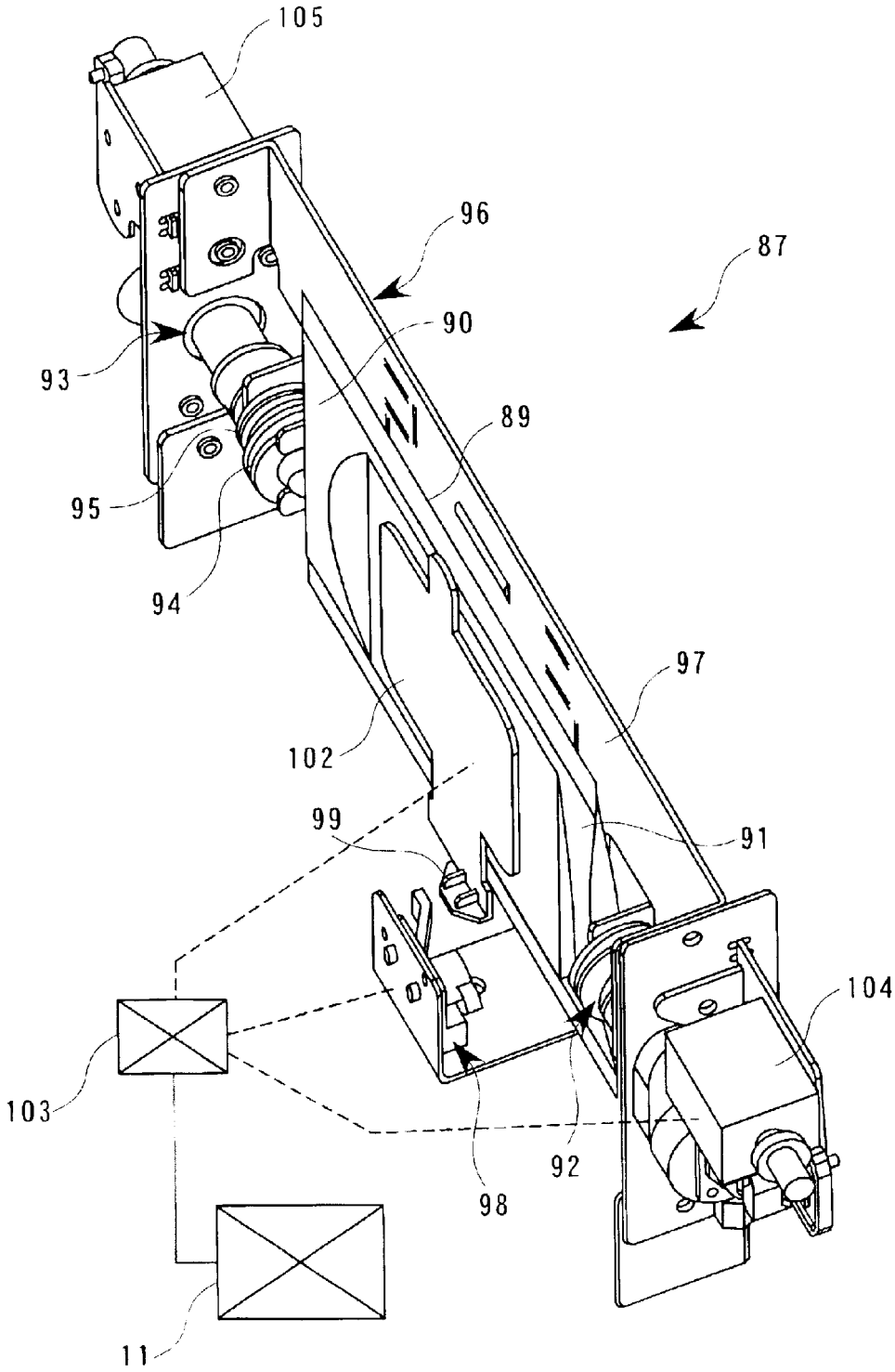
FIG. 10 is a perspective view of a component unit of a sub-tank unit.
Figure 11:
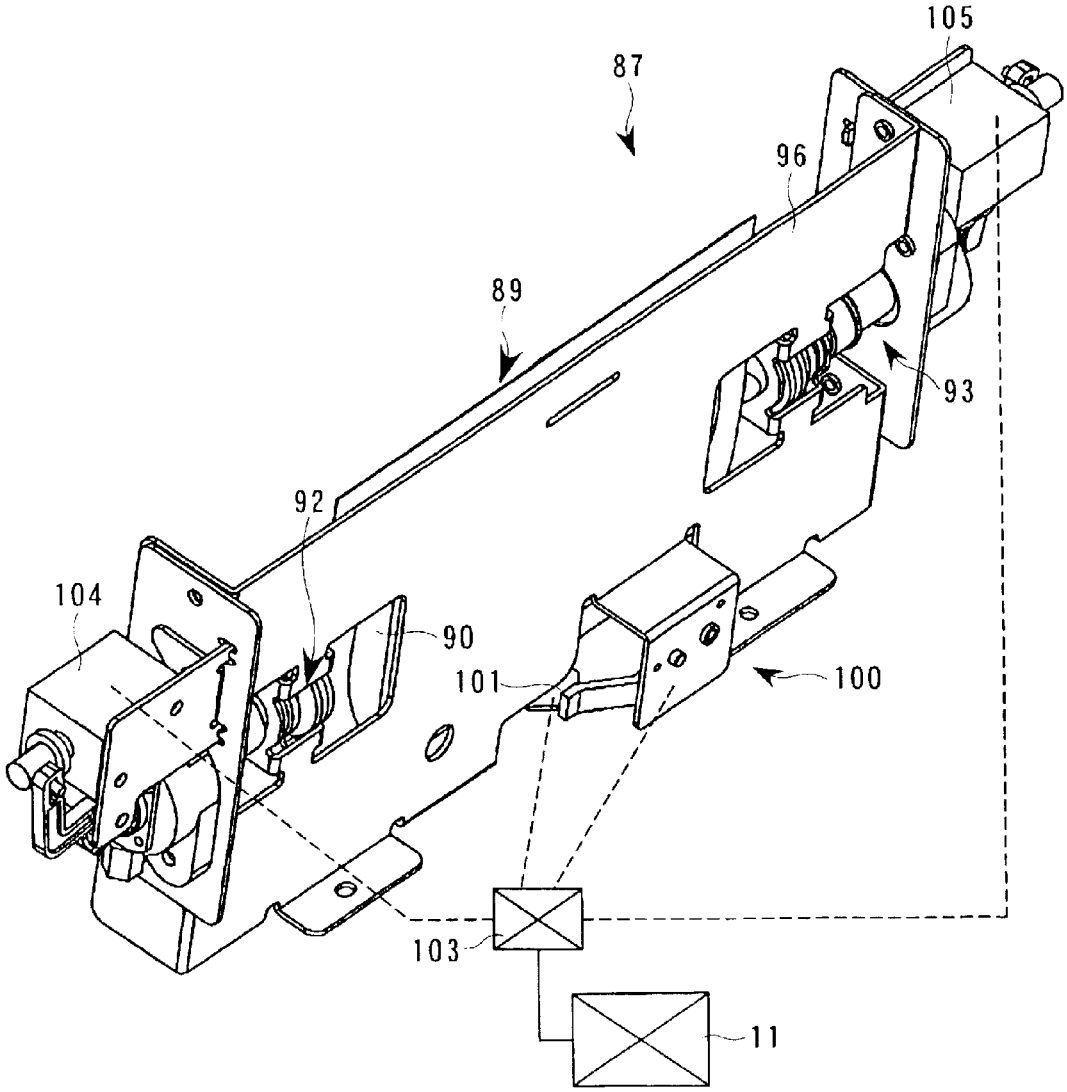
FIG. 11 is a perspective view of the component unit of the sub-tank unit, as viewed from its rear side.
Figure 12:
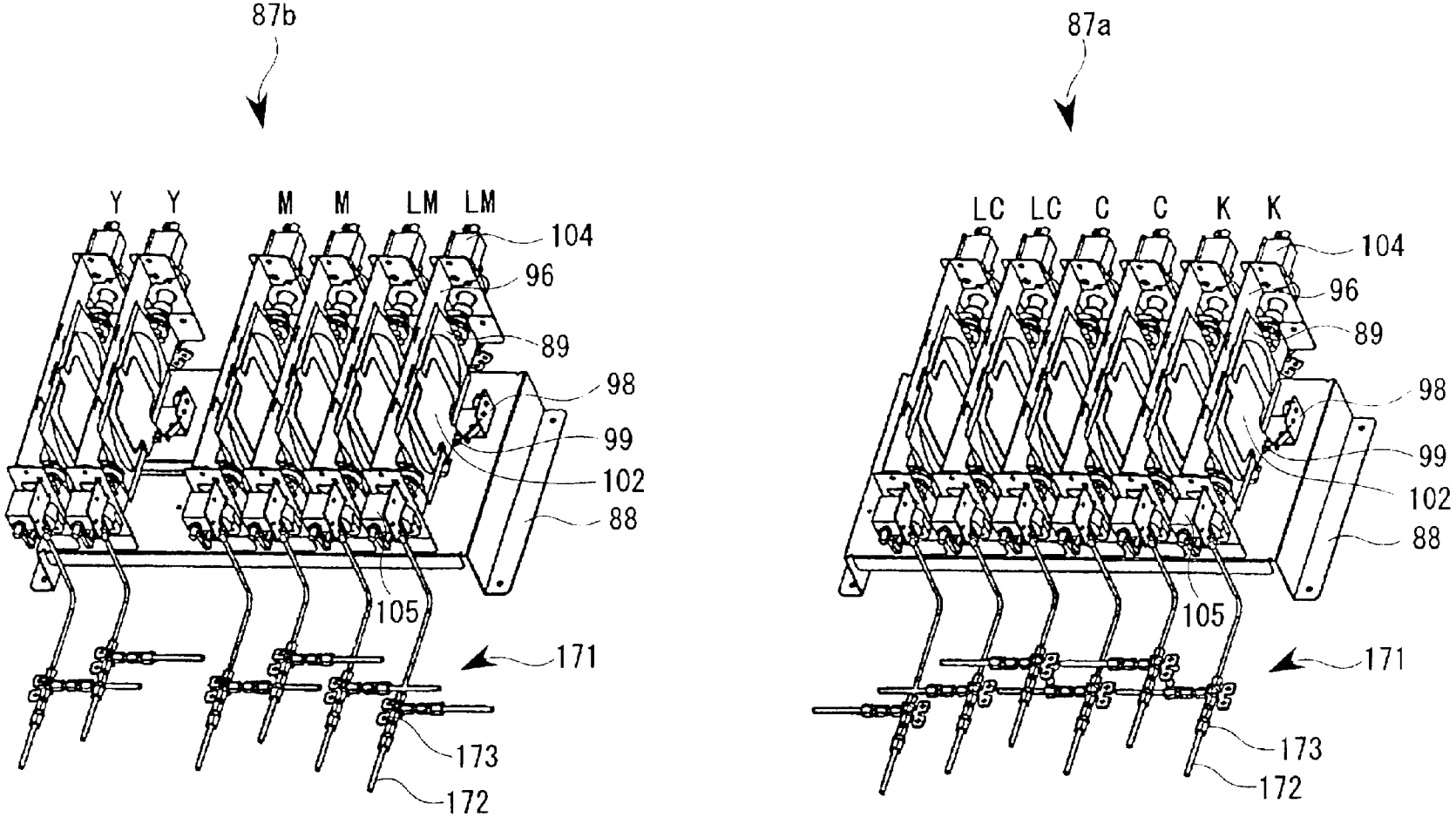
FIG. 12 is a perspective view of the sub-tank unit and component parts associated therewith.

Next, the sub-tank unit 87 will be described with reference to FIGS. 2, 10, and 12. The sub-tank unit 87 is comprised of two sub-units 87*a*, 87*b* arranged on respective left-hand side and right-hand side rear portions of the base plate 13. Each of the sub-units 87*a*, 87*b* includes six intermediate ink packs 89 serving as intermediate tanks, six sub-tank frames 96 for supporting the intermediate ink packs 89 in a state facing horizontally in an upright position, six supply valves 104 each arranged on a main tank unit side of the intermediate ink pack 89, and six discharge valves 105 each arranged on an ink jet head side of the intermediate ink pack 89.

More specifically, each of the sub-units 87*a*, 87*b* is provided with six intermediate ink packs 89 (two for each ink color) arranged in rows, that is, the two sub-units 87*a*, 87*b* include twelve intermediate ink packs 89 in total. The same relationship concerning the numbers of elements applies to the above sub-tank frames 96, supply valves 104, and discharge valves 105. In each sub-unit, the six sub-tank frames 96 are supported on a sub-base plate 88 provided for each sub-unit, and rigidly fixed to the base plate 13 through the sub-base plate 88.

The intermediate ink packs 89 each include a deformable and flexible bag-like intermediate pack body 90, an ink inlet port 92 made of resin and attached to one end of the intermediate pack body 90, an ink outlet port 93 made of resin and attached to the other end of the intermediate pack body 90, and a flow passage-holding pipe, not shown, for connecting the ink inlet port 92 and the ink outlet port 93 through the intermediate pack body 90.

The intermediate pack body 90 is formed into a bag-like shape by affixing two film sheets to each other along peripheries thereof by hot-melt bonding, such that a deformable storing space 91 is formed therein for holding ink. Further, the intermediate pack body 90 has the ink inlet port 92 and the ink outlet port 93 attached to the respective opposite ends thereof in a manner opposed to each other, in a sealed condition. Thus, when ink is filled in the storing space 91, the intermediate pack body 90 in a flat state (ink shortage condition) is changed into a bulged state (ink fill-up condition) in which the film sheets are moved away from each other to be budged into a generally hollow cylindrical shape.

Each sub-tank frame 96 has opposite ends thereof bent such that the sub-tank frame is generally C-shaped. The sub-tank frame 96 is erected on the sub-base plate 88, with an ink high detector 98 arranged at a generally L-shaped portion which is formed by bending a lower end portion of a vertical support portion of the sub-tank frame 96 inward i.e. toward the side of the intermediate ink pack 89 held in the sub-tank frame 96 and then upward, and an ink low detector 100 arranged at a generally L-shaped portion which is formed by bending a lower end portion of the vertical support surface of the sub-tank frame 96 outward and then downward (see FIG. 2). The intermediate ink pack 89 is affixed to an upper portion of the vertical support portion of the sub-tank frame 96 by a double-sided adhesive tape such that it face horizontally in the upright portion in which the intermediate pack body 90 stands vertically with the ink inlet port 92 and the ink outlet port 93 being horizontally positioned.

The intermediate pack body 90 of the intermediate ink pack 89 has a detecting plate 102 attached to a front surface thereof in a manner opposed to the vertical support portion of the sub-tank frame 96. The detecting plate 102 has a lower end which extends both in inward and outward directions (directions of bulging of the pack body), respectively, whereby a "high"-detecting portion 99 protruding toward the ink high detector 98 and a "low"-detecting portion 101 protruding toward the ink low detector 100 are integrally formed with each other. The "low"-detecting portion 101 extends to the ink low detector 100 beyond the bottom of the pack body 90 facing horizontally in the upright position.

The ink low detector 100 is used for detecting the ink shortage condition of the intermediate ink pack 89. When the ink in the ink pack falls short, the "low"-detecting portion 101 spaced from the ink low detector 100 is brought into abutment with the same as the pack body is contracted (detection of "ink low"). As a result, ON/OFF operation of the "low"-detecting portion 101 is carried out to detect ink shortage in the intermediate ink pack 89, and an ink shortage signal indicative of the sensed ink shortage is sent from a sub-controller 103 to the controller 11. Then, the supply valve 104 in a closed state is opened by the controller 11 to supply ink under pressure from the main tank unit 61.

On the other hand, the ink high detector 98 is used for detecting an ink fill-up condition of the intermediate ink pack 89. When the intermediate pack body 90 is bulged by supply of ink, the "high"-detecting portion 99 spaced from the ink high detector 98 is advanced into abutment with the ink high detector 98 (detection of "ink high"). As a result, ON/OFF operation of the "high"-detecting portion 99 is carried out to detect the ink fill-up condition of the intermediate ink pack 89. At this time, although a signal indicative of the sensed ink fill-up condition of the intermediate ink pack 89 is delivered from the sub-controller 103 to the controller 11, before the controller 11 issues an instruction for closing the supply valve 104, the sub-controller 103 issues an instruction for closing the supply valve 104.

The supply valve 104 is formed by an electromagnetic valve (electromagnetic two-way valve) supported by one bent end of the sub-tank frame 96, and opening/closing thereof is controlled by the controller 11 of the ink jet printer 1 and the sub-controller 103. More specifically, the supply valve 104 is automatically opened in response to detection of "ink low" by the ink low detector 100 to supply ink from the ink cartridge 62 to the intermediate ink pack 89 and is normally closed. It should be noted that the supply valve 104 is of course closed during maintenance operation for replacing the intermediate ink pack 89 by a new one.

Each of the discharge valves 105 is formed by an electromagnetic valve (electromagnetic two-way valve) supported by the other bent end of the sub-tank frame 96, similarly to the supply valve 104, and opening/closing thereof is controlled by the controller 11 of the ink jet printer 1. More specifically, the discharge valve 105 is normally open, but it is closed by the controller 11 during maintenance operation. This makes it possible to close an ink supply passage of the tube unit 171 during maintenance operation, thereby smoothly and reliably replacing the ink pack while preventing leakage of ink.

Next, the tube unit 171 will be described with reference to FIGS. 1, 2 and 12. The tube unit 171 includes a plurality of hard tubes 172 for connecting the main tank unit 61, the sub-tank unit 87, and the ink jet heads 34, a plurality of bifurcation couplings 173 connected to the hard tubes 172, and a plurality of tube holders 174 for holding the hard tubes 172 in a piping path on the base 2.

The tubes (six in number) 172 connected to the ink tanks 67 of the main tank unit 61 for the respective -color inks have the other ends thereof connected to ones of the bifurcation couplings 173 on the ink tank side, where they are each bifurcated and are then connected to two intermediate ink packs 89 for each ink color, i.e. twelve intermediate ink packs 89 in total. Further, each of the resulting or branch tubes 172 on the main tank unit side is connected to an associated one of the supply valves 104. On the other hand, the bifurcation couplings 173 on the print head side are each arranged on the base plate 13 and each have one port thereof connected to the tube 172 leading to a corresponding one of the discharge valves 105, and the remaining two ports thereof connected to the associated tubes 172 connected to the ink jet heads 34, respectively. The plurality of (twenty-four) tubes 172 from all the intermediate ink packs 89 to the in jet heads 34 are guided upward from the base plate 13 through an X-axis cable bear 48 and a Y-axis cable bear 49 up to the respective ink jet heads 34, through a piping support plate 175, without causing interference with the other devices (the X-Y moving mechanism 42, etc.).

Next, the maintenance means 10 will be described. The maintenance means 10 includes a flushing box 111 for receiving flushing ink, a storage unit 115 for storing the ink jet heads 34 when they are not driven, a cleaning unit 121 for cleaning the ink jet heads 34 to cope with clogging of the nozzles e.g. by manual (not automatic) operation, and a wiping unit 131 for wiping the ink jet heads 34 by manual (not automatic) operation, all of which are arranged at locations close to portions of the X-axis table 43 rearwardly off the tape feeding path 4.

As shown in FIG. 3, the flushing box 111 includes a bottomed box body 112 arranged on a square frame, an ink absorber 113 laid on the bottom of the box body 112, and a frame-like holding plate 114 rigidly fixed to upper end edges of the box body 112 to hold four side edge portions of the ink absorber 113. Since the mounting position of the flushing box 111 coincides with the origin (reference position) of the X axis, and a rear portion thereof is supported by the X-axis table 43, the flushing box 111 can travel together with the X-axis table 43 along the Y-axis with the position of the origin of the X axis being maintained. Therefore, when printing is carried out, the flushing box 111 always faces the head unit 31 having been moved rearward to the origin of the X axis, in a manner covering the head unit 31 from below. Hence, it is possible to flush the head unit 31 whenever the head unit 31 performs one reciprocating motion (for printing two lines) during printing operation, thereby reducing a printing time period as a whole. Further, it is preferable that the flushing of the head unit 31 is first carried out when printing is started.

Figure 13A:
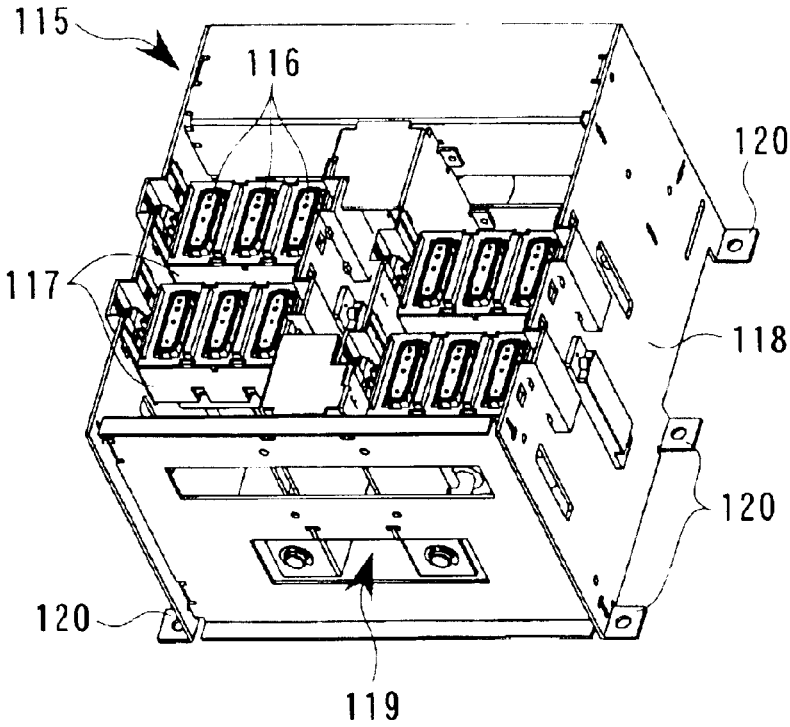
Figure 13B:
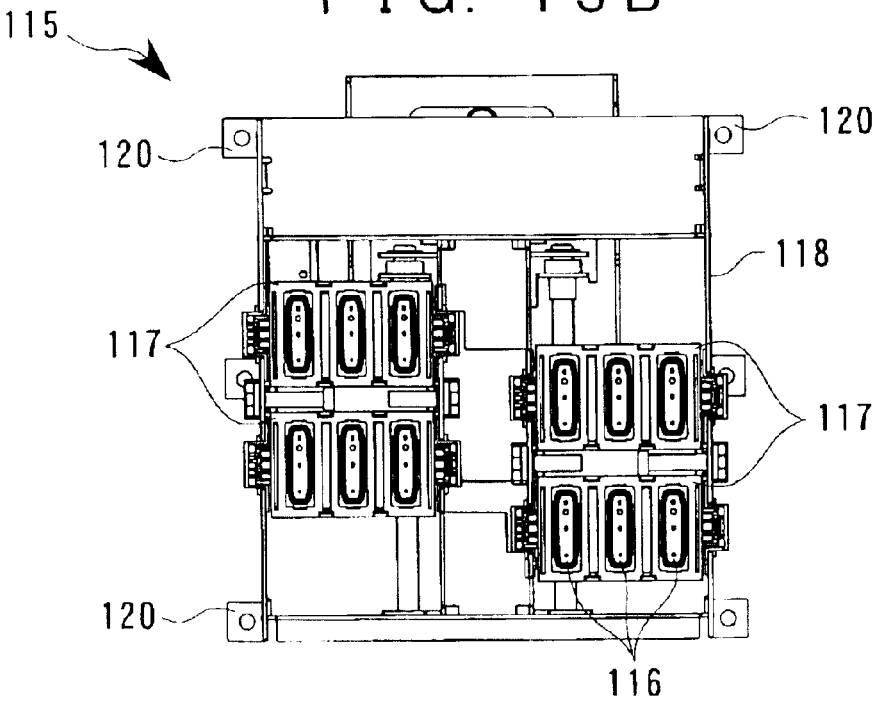

As shown in FIG. 1 and FIGS. 13A and 13B, the storage unit 115 is arranged at an approximately central portion of the base 2, and includes four cap-supporting members 117 each having three storage caps 116 (cap members) mounted thereon, a storage base frame 118 for accommodating the cap-supporting members 117 by allowing each to vertically slide therein, and a cap-moving mechanism 119 for moving the storage caps 116 the number of which is twelve in total, up to and away from the head unit 31 through the four cap-supporting members 117. Thus, when the ink jet heads 34 are not driven, the ink jet heads 34 (ink nozzles) are sealed individually by the storage unit 115, thereby making it possible to hold them in high humidity. It should be noted that the cap-moving mechanism 119 is connected to the controller 11, and the storage base frame 118 is screwed to a predetermined location of the base plate 13 through a total of six left and right fixing portions 120 formed at lower ends of the storage base frame 118.

Figure 14A:
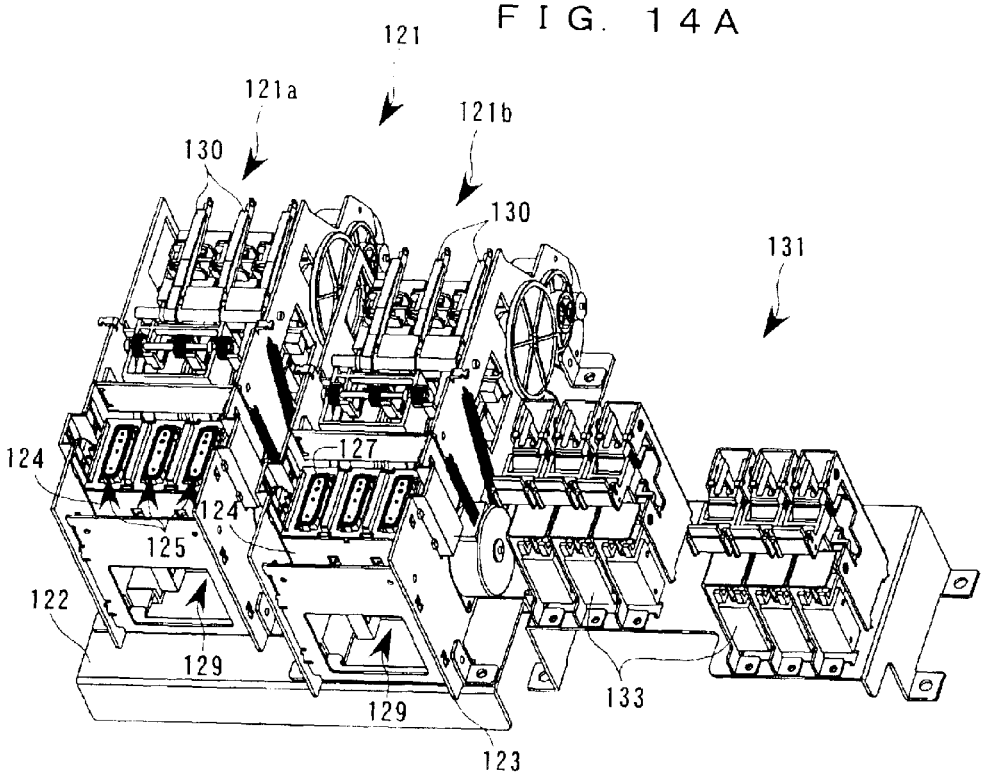
Figure 14B:
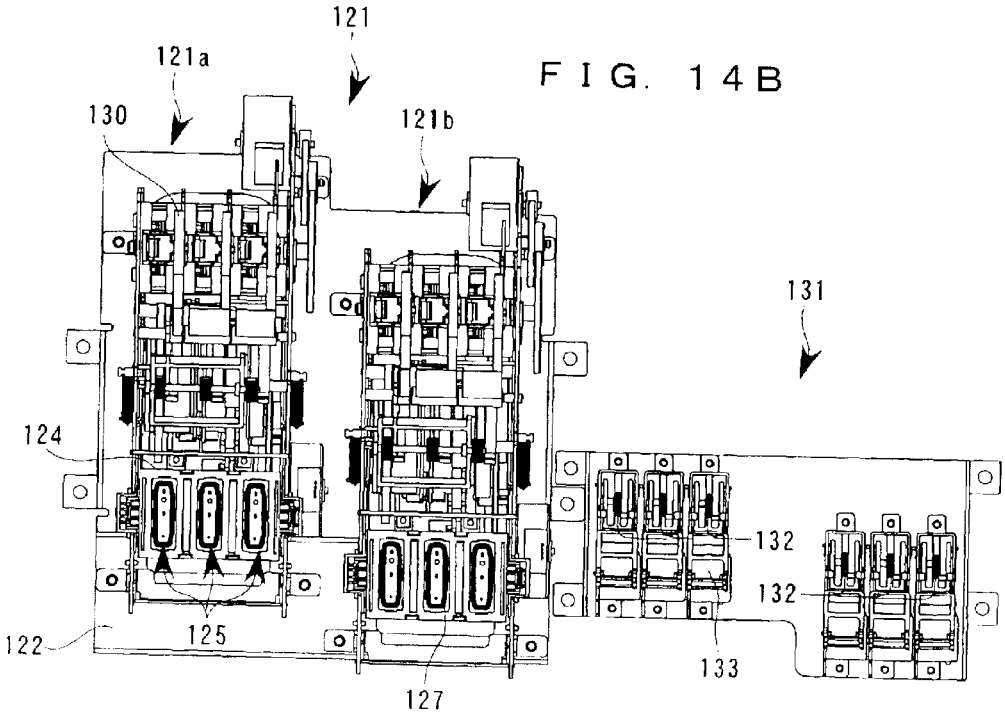

As shown in FIG. 1 and FIGS. 14A and 14B, the cleaning unit 121 is comprised of two sub-units 121*a*, 121*b*, which are each supported by a cleaning base plate 122 rigidly fixed to the base plate 13, and arranged in a manner displaced from each other in the Y-axis direction.

Each of the sub-units 121*a*, 121*b* of the cleaning unit 121 includes cleaning caps 125 which are configured such that they can be brought into intimate contact with the respective ink jet heads 34, a cleaning cap support member 124 having the cleaning caps 125 mounted thereon for moving upward and downward the cleaning caps such that the cleaning caps 125 are associated with the ink jet heads 34 (head groups 35), respectively, a cleaning cap-moving mechanism 129 for moving the cleaning caps 125 up to and away from the head unit 31 through the cleaning cap support member 124, and an ink pump 130 for sucking ink through the cleaning caps 125. It should be noted that the cleaning cap-moving mechanism 129 and the ink pumps 130 are connected to the controller 11.

Now, cleaning operation will be described with reference to FIGS. 6A to 6C and FIGS. 14A and 14B. When the head groups 35 are brought to the cleaning unit 121 for cleaning, the cleaning cap-moving mechanisms 129 operate to lift the cleaning cap support members 124 to bring the cleaning caps 125 into intimate contact with the head unit 31. Subsequently, the ink pumps 130 operate to suck inks from the ink nozzles of the ink jet heads 34 into ink absorbent material 127 contained under the caps 125 for cleaning the ink jet heads 34. It should be noted that the inks sucked by the ink pumps are guided to the waste ink tank 18 through the respective ink tubes 172 from the ink absorbent material 127. Further, the cleaning unit 121 has sensor switches, not shown, for detecting respective wait positions of the cleaning cap support members 124. The sensor switches interlock the movement of the head unit 31 when the cleaning cap support members 124 are in sealing position.

As shown in FIG. 1 and FIGS. 14A and 14B, the wiping unit 131 is arranged adjacent to the cleaning unit 121 at a location of a distal end of the head unit 31 in the direction of the X axis, off a printing area G of the printing tape A. Further, similarly to the cleaning unit 121, the wiping unit 131 has sub-units arranged in a manner displaced from each other in the Y-axis direction such that they are associated with the two adjacent head groups 35. The wiping unit 131 includes wiper blades 132 made of resin, and solenoids 133 for rotating and lifting the wiper blades 132. The solenoids 133 are connected to the controller 11 for being controlled thereby.

When the head unit 31 is brought to a position immediately above the wiping unit 131, the solenoids 133 are excited to rotate and lift the wiper blades 132 to a wiping position where the wiper blades 132 are in abutment with the ink jet heads 34. Then, the X-Y moving mechanism 42 operates to move the head unit 31 along the X axis over a very small distance, whereby wiping operation is carried out. By carrying out the wiping operation, it is possible to remove ink attached to underside surfaces (ink nozzle surfaces) of the ink jet heads 34 to maintain a proper meniscus at ends of the ink nozzles.

As described above, according to the maintenance means 10, the storage unit 115 for storing the ink jet heads 34 is arranged independently of the flushing box 111 and the cleaning unit 121, so that it is possible to properly protect the ink jet heads 34 as well as to prevent adverse effects of contamination with ink caused by ejection (suction) of the same in comparison with a case in which the ink jet heads 34 are stored in the cleaning unit 121 or the like.

Next, the tape feeding means 7 (paper-feeding device) will be described with reference to FIG. 1. As shown in the figure, the tape feeding means 7 includes the suction table 141 arranged on the base plate 13 in a generally central portion of the tape feeding path 4, and a tape feeding mechanism 144 whose sections are arranged on opposite sides of the suction table 141 for feeding the printing tape A along the tape feeding path 4.

Each suction fan, not shown, sucks air through suction holes 142 arranged in the suction table 141 in a staggered arrangement, whereby the printing tape A is held in a horizontal position to prevent it from being lifted. A feed motor, not shown, of the tape feeding mechanism 144, which is controlled by the controller 11 for rotation in synchronism with motion of the head unit 31, drives a tape feed roller 146 for rotation to feed and stop the printing tape A with high accuracy.

Next, the tape take-up means 8 will be briefly described with reference to FIG. 1. The tape take-up means 8 includes a tape take-up reel 151 rotatably supported by the finisher body 20, a take-up roller 152 located at a position immediately above the tape take-up reel 151, a take-up motor, not shown, for driving the take-up roller 152 for rotation, a take-up guide roller 154 arranged at a location close to the take-up roller 152 in a manner opposed thereto, a width control means 155 for controlling the position of a printed part of the printing tape A in the direction of the width of the tape, and a retaining roller 156 positioned between the finisher 3 and the base 2. Printed part of the printing tape A sent from the tape feeding means 7 is guided through the retaining roller 156 to the width control means 155, where guiding of the printed part while controlling its position in the direction of width thereof is carried out, and then taken up into a roll by the tape take-up reel 151.

Next, the tape supply means 6 will be described with reference to FIG. 1. The tape supply means 6 has a support comprised of a supply support frame 161 and a bracket 163 rigidly fixed to associated ones of the angle bars 12. The supply support frame 161 supports a supply roller 162, a supply motor 165 for driving the supply roller 162 for rotation, and an adjustment arm 166. The bracket 163 has a supply reel 164 arranged thereon for rotatably supporting a roll of the printing tape A. The adjustment arm 166 has a light-blocking plate arranged at a root portion thereof. There are two photo interrupters arranged on one arm of the supply support frame 161 in a manner facing a path of movement of the light-blocking plate. The photo interrupters are connected to the controller 11 together with the supply motor 165. The printing tape A is supplied by the driving of the supply motor 165, which is controlled based on the detection of the light-blocking plate of the adjustment arm 166 by the photo interrupters. The supply roller 162 rolls out the printing tape A forward to supply the same to the printing means 5 such that the amount of loosening of the printing tape A generated between an adjustment roller 167 and a supply guide member 168 is set to a value larger than the amount of feeding of the printing tape A fed by one feed operation.

Figure 15:
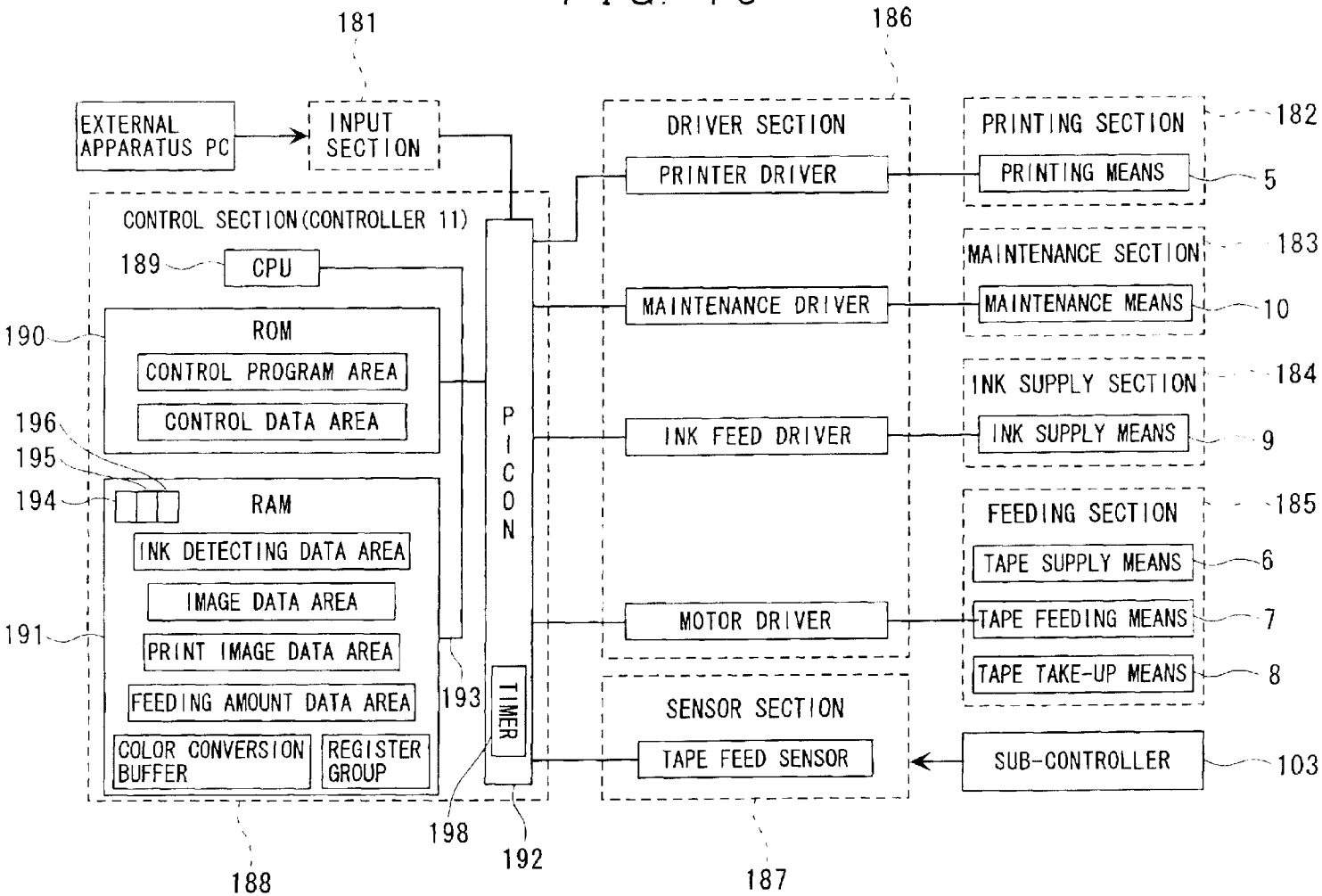
FIG. 15 is a block diagram schematically showing a control system of the ink jet printer according to the embodiment.

Next, a main control system forming the controller 11 will be described. Referring to FIG. 15, the control system of the ink jet printer 1 is comprised of an input section 181 for reading (inputting) image data prepared by an external apparatus, such as a personal computer (PC), according to operations of the same, a printing section 182 having the printing means 5, for printing images on the printing tape A, a maintenance section 183 having the maintenance means 10, for carrying out maintenance of the ink jet heads 34, an ink supply section 184 having the ink supply means 9, for supplying ink to the ink jet heads 34, a feeding section 185 having the tape supply means 6 (supply motor 165), the tape feeding means 7 (tape feed motor 145), and the tape take-up means 8 (take-up motor 153), for feeding the printing tape A, a driver section 186 having various drivers for driving the sections and devices of the ink jet printer 1, a sensor section 187 having the sub-controller 103, a tape feed sensor of the tape feeding means 7, etc., for carrying out various detecting operations, and a control section 188 (controller 11) for controlling operations of the sections and devices of the ink jet printer 1.

The control section 188 has a CPU 189, a ROM 190, a RAM 191, and a P-CON 192, all of which are connected to each other through a bus 193. The ROM 190 has a control program area for storing control programs operations of which are executed by the CPU 189, and a control data area for storing control data including character tables and color conversion tables. The RAM 191 includes an image data area for storing image data inputted from outside of the ink jet printer 1, a print image data area for storing image data for printing, a feeding amount data area for storing data of the amount of feeding of the printing tape A, and an ink detecting data area for storing data necessary for detection of ink, referred to hereinafter, as well as color conversion buffer areas corresponding to the colors of inks, and groups of various kinds of registers. The RAM 191 is used as a work area for carrying out the control process.

Further, the control section 188 includes a sub-tank consumption counter 195 for counting the amounts of ink consumed through the respective intermediate ink packs (sub-tanks) 89 on an intermediate ink pack-by-intermediate ink pack basis, according to the control program read from the ROM 190, based on the operation of the ink jet heads 34, an ink cartridge consumption counter 194 for storing the cumulative totals of the counts of the sub-tank consumption counter 95 counted for the intermediate ink packs 89 connected to the ink cartridges (main tanks) 62, i.e. sub-tank consumption counter values, on an ink cartridge-by-ink cartridge basis (main tank-by-main tank basis), a sub-tank maintenance counter 196 for counting the numbers of times of ink replenishment in which the respective intermediate ink packs 89 receive ink from the corresponding ink cartridges 62. The counts or counter values of the above counters are stored in the RAM 191. More specifically, the above counts (counter values) are stored in the ink detecting data area within the RAM 191. Further, items of information of attributes of the inks are also stored in the ink detecting data area.

The ink consumption amount counted by the sub-tank consumption counter 195 is calculated e.g. by multiplying an ink ejection amount per ejecting operation of each ink jet head 34, by the number of times of ink ejection. Each ink consumption amount calculated whenever ink is ejected from the ink jet head 34, more specifically, whenever printing, cleaning, or flushing operation is carried out, is added to the corresponding count of the sub-tank consumption counter 195, to rewrite the existing value (count). The stored value of the sub-tank consumption counter 195 is reset after it is added to the corresponding or related count of the ink cartridge consumption counter 194 before the intermediate ink pack 89 associated therewith has ink replenished from the ink cartridge 62.

Each count of the ink cartridge consumption counter 194 stored in the RAM 191 is the cumulative total of respective values of the corresponding or related counts (for the same ink color) of the sub-tank consumption counter 195. Before ink is supplied from the ink cartridge 62 to one of the intermediate ink packs 89, the count of the sub-tank consumption counter 195 as to the intermediate ink pack 89 is added to the corresponding count of the ink cartridge consumption counter 194, to rewrite the same. Additionally, the rewriting operation is carried out when there occurs abnormal stoppage of the printer 1, when the maintenance door 24 is opened and closed, before an initial filling process is carried out for filling the sub-tanks with ink for the first time after installation of the printer 1, and at the time of occurrence of an ink end of the ink cartridge 62 (i.e. when ink therein is used up).

However, as described in detail hereinafter, at the time of occurrence of an ink end of the ink cartridge 62 (detected by a timer 198 for the intermediate ink pack), a value of an amount (ink-end reference value) of ink which is provided in advance and by far larger than a value corresponding to the capacity of the ink cartridge 62, is written in to the IC chip 106 of the ink cartridge 62 as the count of the ink cartridge consumption counter 194. Further, it is preferred that at the time of replacement of an ink cartridge 62, the corresponding count of the ink cartridge consumption counter 194 having been stored in the RAM 191 is reset so as to cause the count of the ink cartridge consumption counter 194 stored in the RAM 191 to agree with the amount of ink consumed through an ink cartridge 62 newly set by the replacement.

The counting of the sub-tank maintenance counter 196 is carried out before ink starts to be supplied from an ink cartridge 62 to an intermediate ink pack 89. In the counting, one count is added to the corresponding count of the sub-tank maintenance counter 196 per ink-replenishing operation. When an intermediate ink pack 89 is to be replaced due to expiration of a service life thereof, the corresponding value of the sub-tank maintenance counter 196 is reset.

The P-CON 192 incorporates a logic circuit implemented by gate arrays, a custom LSI and the like, for complementing the functions of the CPU 189 as well as dealing with interface signals for interfacing between the CPU 189 and peripheral circuits. Accordingly, the P-CON 192 is connected to a keyboard or the like of a personal computer, for receiving instructions and image data from the input section 181, and inputting these to the internal bus 193 directly or after processing them. Further, the P-CON 192 cooperates with the CPU 189 to output data and control signals input to the internal bus 193 by the CPU 189 and the like, to the driver section 186 directly or after processing them.

Due to the construction described above, the CPU 189 of the control section 188 receives signals from sensors, commands and data, through the P-CON 192, according to the control program read from the ROM 190, processes various data stored in the RAM 191, and delivers control signals to the driver section 186 through the P-CON 192 to thereby control the operations of the printing means 5, the tape feed motor 145, and so forth, to perform printing on the printing tape A and feeding of the same under predetermined printing and tape feeding conditions. In short, the CPU 189 controls the overall operation of the ink jet printer 1.

Figure 16:
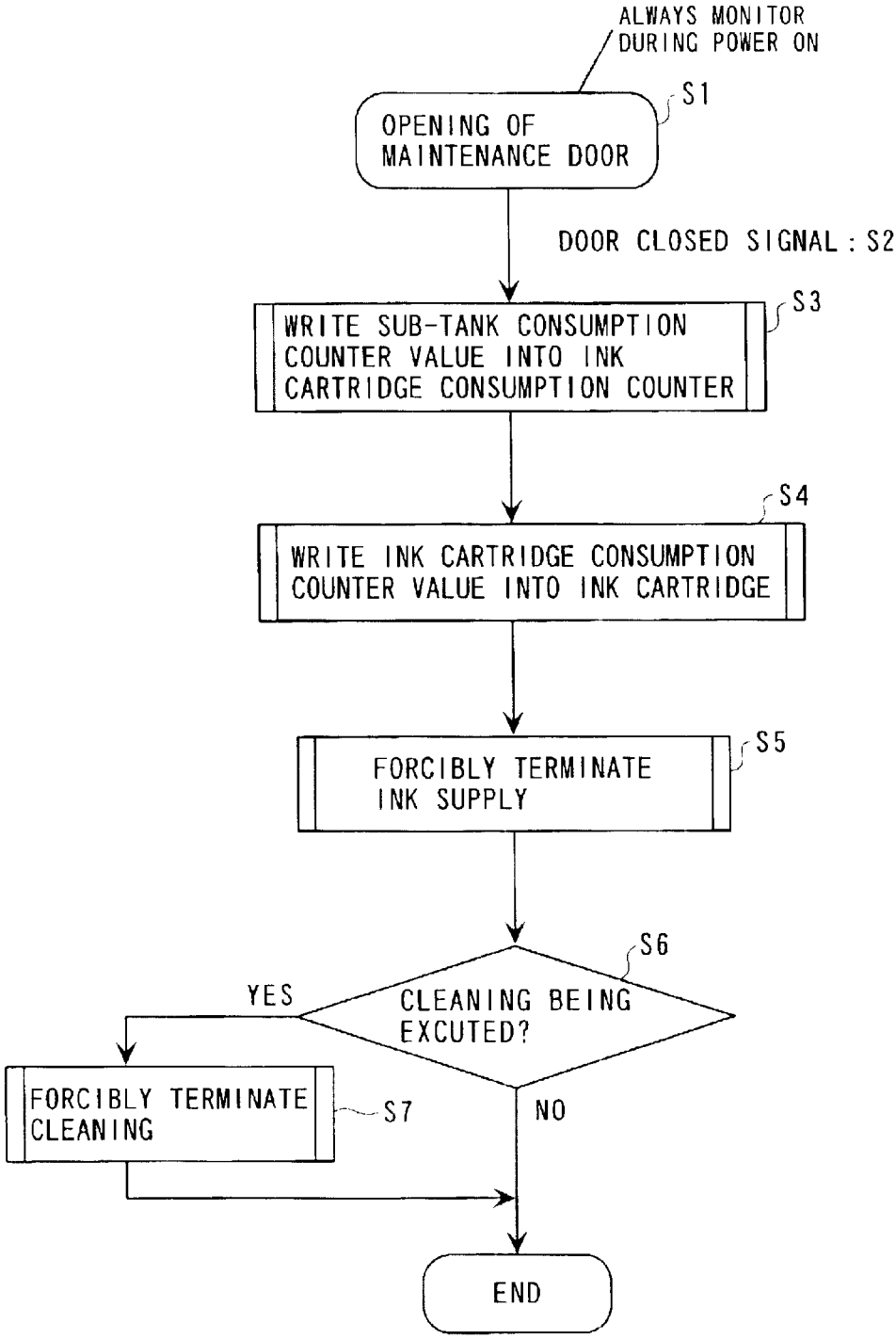
FIG. 16 is a flowchart showing a flow of a control process carried out when a maintenance door (door of a tank-accommodating block) is opened during operation of the apparatus.

Now, a control method employed in the ink jet printer according to an embodiment of the present invention (ink jet recording apparatus) will be described hereinafter. First, a control method employed when the maintenance door 24 is opened is described. Referring to FIG. 16 showing a flowchart of the present control process, when the maintenance door 24 is opened in a step S1, a door open signal is delivered from the sensor 25 to the controller 11 in a step S2. Then, in a step S3, in response to the signal, each value of the sub-tank consumption counter 195 counted by the control section 188 is added to the corresponding value of the ink cartridge consumption counter 194, to rewrite the same. The rewritten value of the ink cartridge consumption counter 194 is written into the IC chip 106 of the corresponding ink cartridge 62 in a step S4.

Then, in a step S5, all the supply valves 104 are closed and the operation of the pressure pump 83 of the air supply mechanism 81 is stopped. Then, the switching valve 86 is operated to switch the air release valves 80 for releasing the pressure in the pressure tank 70 (forced termination of ink supply). Subsequently, it is checked in a step S6 whether or not cleaning operation is being carried out. If cleaning operation is being carried out, (Yes to S6), forced termination of the cleaning operation is executed in a step S7.

Figure 17:
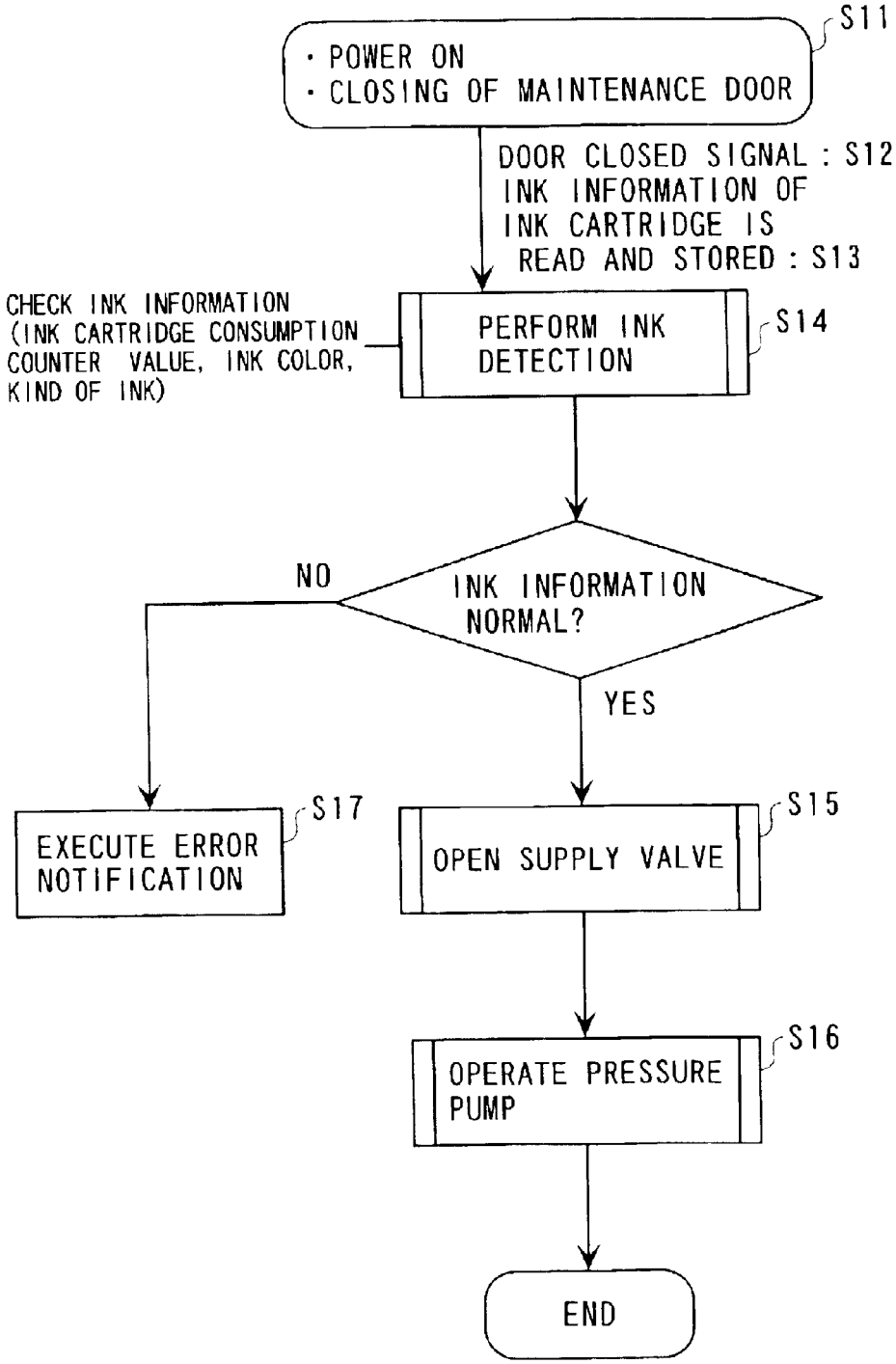
FIG. 17 is a flowchart showing a flow of a control process carried out when the maintenance door is closed during operation of the apparatus.

Next, a control method employed when the maintenance door 24 is closed will be described with reference to FIG. 17. When the maintenance door 24 is closed in a step S11, a door closed signal is delivered from the sensor 25 to the controller 11 in a step S12. In response to the signal, first, the value of the ink cartridge consumption counter 194 stored in the IC chip 106 of each ink cartridge 62, and ink information of ink attributes, such as ink colors, stored in the IC chip 106, are read and stored in the RAM 191 in a step S13. Next, an ink-detecting process is carried out in a step S14 to check whether or not this attribute information and the attribute information (ink information) stored in the ink detecting data area agree with each other. If it is judged that these ink information items agree with each other and hence the ink information input from each IC chip 106 is normal (Yes to S14), the supply valves 104 are opened in a step S15, and the pressure pump 83 is operated to send ink from the main tank unit 61 to the sub-tank unit 87 in a step S16.

On the other hand, as a result of execution of the ink-detecting process, if it is judged that the ink information of ink attributes input from the IC chip 106, and the ink information of ink attributes stored in the RAM 191 are different from each other, and hence the ink information input from the IC chip 106 is abnormal (No to S14), in a step S17, error notification is executed e.g. by causing an alarm lamp to blink. Further, also when it is found by the ink-detecting process, that the value of the ink cartridge consumption counter 194 input from the IC chip 106 is equal to or larger than the ink-end reference value stored in the RAM 191, it is judged that there has occurred an ink end of the corresponding ink cartridge 62, and error notification is executed in a step S17. Although an ink cartridge 62 before an ink end is likely to be set by the replacement, it is not checked in the step S14 whether or not the value of the ink cartridge consumption counter 194 agrees with the value stored in the RAM 191, to continue using the ink cartridge so long as there remains ink therein.

Figure 18:
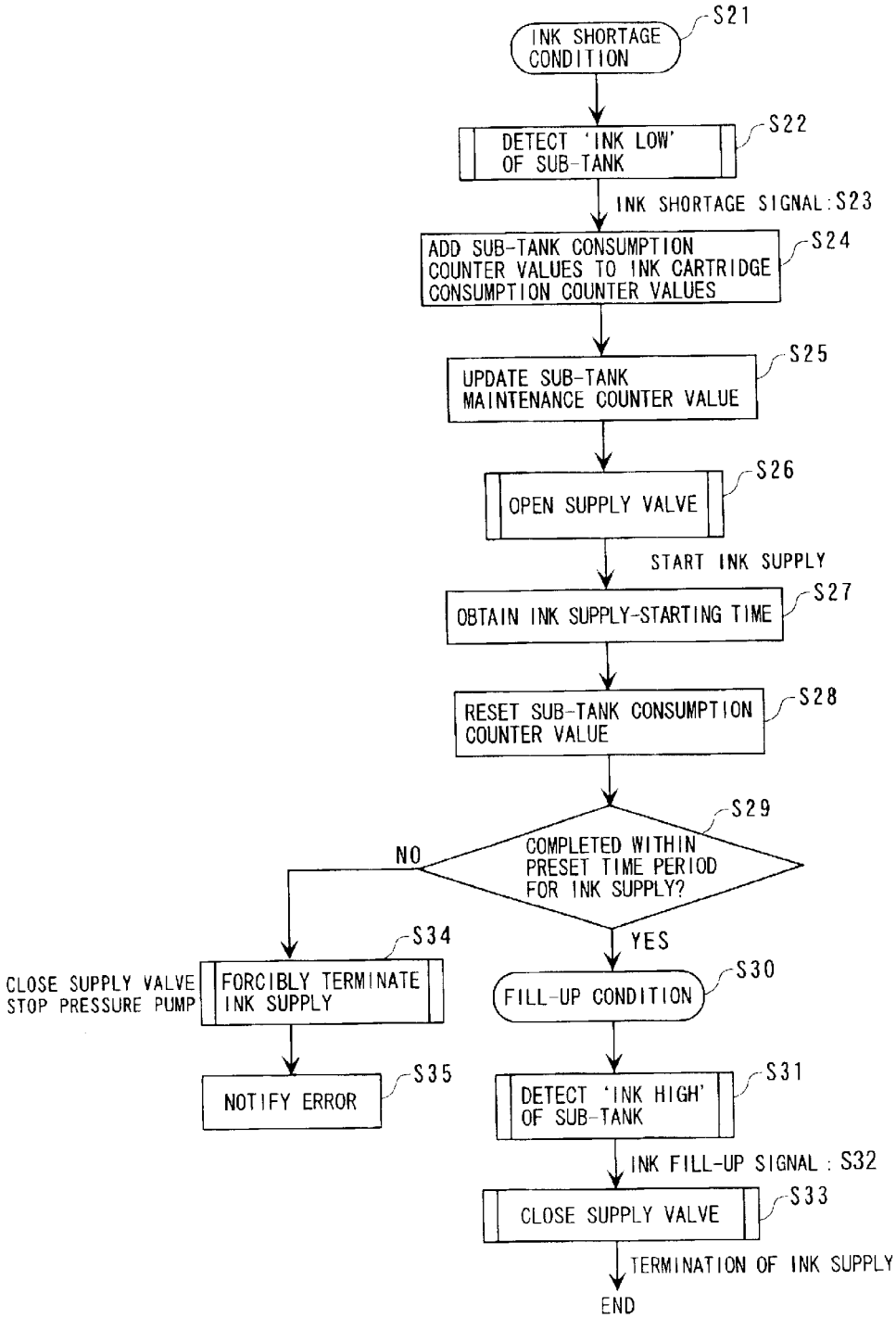
FIG. 18 is a flowchart showing a flow of a control process concerning ink replenishment.

Next, a control method employed when ink is replenished from the main tank unit 61 to the sub-tank unit 87 will be described with reference to FIG. 18. First, when one of the ink packs 89 is short of ink in a step S21, the ink shortage of the ink pack 89 is detected by the ink low detector 100 in a step S22, and an ink shortage signal indicative of the sensed ink shortage condition is delivered to the controller 11 in a step S23. In response to the ink shortage signal, before supplying ink, the controller 11 adds the count of the sub-tank consumption counter 195 associated with the intermediate ink pack 89 to the corresponding value of the ink cartridge consumption counter 194 in a step S24, and adds one count to the value of the sub-tank maintenance counter 196 in a step S25. Then, to supply ink only to the intermediate ink pack 89 in the ink shortage condition, the controller 11 opens only the supply valve 104 of the intermediate ink pack 89 whose ink shortage condition has been detected, to supply ink thereto, in a step S26. At the same time, the controller 11 obtains an ink supply-starting time in a step S27, and resets the corresponding value of the sub-tank consumption counter 195 in a step S28.

While ink is supplied or replenished to the corresponding intermediate ink pack 89 in response to the opening of the supply valve 104, the control section 188 calculates an ink supply time period based on the obtained ink supply-starting time by using the timer 198, and detects in a step S29 whether or not the ink supply time period is within a preset time period for the ink supply. Then, in a step S30, assuming that the corresponding intermediate ink pack 89 is filled with ink before the ink supply time period exceeds the preset time period (Yes to S29), the ink high detector 98 detects the ink fill-up condition of the ink pack 89 in a step S31, to deliver an ink fill-up signal indicative of the sensed ink fill-up condition of the ink pack 89 to the sub-controller 103 and the controller 11 in a step S32, and the sub-controller 103 delivers an instruction for closing the supply valve 104. After that, the controller 11 also controls the supply valve 104 to close in a step S33, followed by terminating the ink replenishment.

On the other hand, if the ink supply is not terminated within the preset time period (No to S29), the ink supply is forcibly terminated in a step S34, followed by executing error notification e.g. by causing the alarm lamp to blink, in a step S35. Although it is considered that in rare cases, this error notification is executed also when ink supply is stopped due to a failure of the printer 1 (leakage of ink or the like), it is almost always executed due to an ink end of the ink cartridge 62. Therefore, as described above, the ink-end reference value is written in the IC chip 106 of the ink cartridge 62 in response to the error notification. Further, the above fact means that ink cartridges 62 are used until they become completely empty, and hence the resource saving is taken into account.

Although in the above ink supply control method, ink is supplied only to an intermediate ink pack 89 in the ink shortage condition, the control method may be configured such that all the intermediate ink packs 89 are supplied with ink if at least one of the plurality of intermediate ink packs 89 is short of ink. If it is judged (S22) that out of the plurality of intermediate ink packs 89, at least one of them is short of ink (S21), in order to start to supply ink to all the intermediate ink packs 89, the controller 11 adds, in response to the ink shortage signal (S23), the sub-tank consumption counter values of all the intermediate ink packs 89 to the corresponding values of the ink cartridge consumption counter 194 (S24). Thereafter, the controller 11 adds one count to all the values of the sub-tank maintenance counter 196 (S25), controls all the supply valves to be opened (S26), obtains the ink supply-starting time for each sub-tank (S27), and resets the values of the sub-tank consumption counter 195 (S28). Assuming that each intermediate ink pack 89 is filled with ink before the ink supply time period exceeds the preset time period (S29), the supply valves 104 are closed to terminate the ink supply, according to detection of the ink fill-up conditions of the ink packs 89 (S31) by the ink fill-up signals indicative of the sensed conditions of the ink packs 89 (S32). Assuming that there is any intermediate ink pack 89 the ink supply to which has not been terminated even after the ink supply time period exceeds the time period set for the ink supply operation (No to S29), the ink supply thereto is forcibly terminated (S34), followed by executing the error notification (S35).

Further, the apparatus may be configured such that if there is an intermediate ink pack 89 which is not filled with ink, all the intermediate ink packs 89 are controlled to be supplied with ink. More specifically, if the ink high detector 98 has judged that out of the plurality of intermediate ink packs 89, at least one ink pack 89 is not filled with ink, in order to supply all the sub-tanks with ink, the controller 11 performs adding and rewriting operations for all the values of the ink cartridge consumption counter 194 (S24) and all the values of the sub-tank maintenance counter 196 (S25), and then controls all the supply valves 104 to be opened (S26) for supplying ink to all the intermediate ink packs 89. The controller 11 obtains the ink supply-starting time for each sub-tank (S27) simultaneously with the start of ink supply operation, and resets the values of the sub-tank consumption counter 195 (S28). Then, if it is detected (S31) that the intermediate ink packs 89 are filled with ink (S30) within the preset time period (S29), the controller 11 closes the supply valves 104 of the intermediate ink packs 89 (S33) in response to the ink fill-up signals (S32), followed by terminating the ink supply operation. If there is an intermediate ink pack 89 the ink supply to which has not been terminated within the preset time period (No to S29), the controller 11 forcibly terminates the ink supply to the intermediate ink pack 89 (S34), followed by executing error notification (S35).

It is further understood by those skilled in the art that the foregoing is the preferred embodiment of the invention, and that various changes and modifications may be made without departing from the spirit and scope thereof.

What is claimed is:

1. A method of controlling an ink jet recording apparatus including a main tank having an information storage section for storing an ink amount and ink attributes as ink information and replaceably received in a pressure tank, a sub-tank communicating with an ink jet head and storing ink sent from the main tank by pressure in the pressure tank, a tank-accommodating block for accommodating the main tank together with the pressure tank, and a control section capable of storing the ink information to be stored in the main tank, wherein the ink jet recording apparatus supplies the ink in the main tank to the sub-tank by opening and closing a valve arranged on an upstream side of the sub-tank in response to a signal indicative of an ink fill-up/shortage condition of the sub-tank, the method comprising the step of:

stopping operation of a pressure source for pressurizing the pressure tank and at the same time making an inside of the pressure tank open to the atmosphere as well as writing an item of the ink information concerning the ink amount of the main tank stored in the control section into the information storage section of the main tank, in response to a signal indicative of opening of a door of the tank-accommodating block during operation of the apparatus.

2. The method according to claim 1, further comprising the step of closing the valve arranged on the upstream side of the sub-tank in response to the signal indicative of opening of the door of the tank-accommodating block during operation of the apparatus.

3. The method according to claim 1, further comprising the step of stopping cleaning operation of sucking ink from the ink jet head in response to the signal indicative of opening of the door of the tank-accommodating block during operation of the apparatus.

4. The method according to claim 1, further comprising the steps of:

starting operation of the pressure source for pressurizing the pressure tank in response to a signal indicative of closing of the door of the tank-accommodating block during operation of the apparatus, when an item of the ink information concerning the ink attributes stored in the information storage section of the main tank and an item of the ink information concerning the ink attributes read out from the control section agree with each other, and at the same time when ink end information indicative of an ink-used-up condition is not contained in the item of the ink information concerning the ink amount stored in the information storage section of the main tank; and executing error notification in response to the signal indicative of closing the door of the tank-accommodating block during operation of the apparatus, when the item of the ink information concerning the ink attributes stored in the information storage section of the main tank and the item of the ink information concerning the ink attributes read out from the control section are different from each other, or when the ink end information is contained in the item of the ink information concerning the ink amount of stored in the main tank.

5. The method according to claim 1, wherein the ink end information is a predetermined value of the ink amount exceeding a capacity of the main tank.

6. The method according to claim 1, wherein the ink jet head, the sub-tank, and the main tank comprise a plurality of ink jet heads, a plurality of sub-tanks, and a plurality of main tanks, provided for different ink colors, the method further comprising the steps of:

starting ink supply on a sub-tank-by-sub-tank basis in response to a signal indicative of detection of shortage of ink in the sub-tank; and stopping the ink supply in response to a signal indicative of detection of a fill-up of ink in the sub-tank on a sub-tank-by-sub-tank basis.

7. The method according to claim 1, wherein the ink jet head, the sub-tank, and the main tank comprise a plurality of ink jet heads, a plurality of sub-tanks, and a plurality of main tanks, provided for different ink colors, the method further comprising the steps of:

starting ink supply to the sub-tanks in response to a signal indicative of detection of shortage of ink of at least one of the plurality of sub-tanks; and stopping the ink supply in response to a signal indicative of detection of a fill-up of ink, on a sub-tank-by-sub-tank basis.

8. The method according to claim 1, wherein the ink jet head, the sub-tank, and the main tank comprise a plurality of ink jet heads, a plurality of sub-tanks, and a plurality of main tanks, provided for different ink colors, the method further comprising the steps of:

starting ink supply to all sub-tanks when at least one of signals each indicative of detection of a fill-up of a corresponding one of the plurality of sub-tanks is turned off; and stopping the ink supply in response to a signal indicative of detection of a fill-up of ink, on a sub-tank-by-sub-tank basis.

9. The method according to claim 1, further comprising the step of executing error notification when an actual replenishing time period from a start of the ink supply to each sub-tank to detection of a fill-up of ink therein exceeds a predetermined time period.

10. The method according to claim 9, wherein the step of executing error notification comprises the steps of:

stopping operation of the pressure source for pressurizing the pressure tank and making an inside of the pressure tank open to the atmosphere; and writing the item of the ink information concerning the ink amount of the main tank stored in the control section, into the information storage section of the main tank.

11. A method of controlling an ink jet recording apparatus including a main tank having an information storage section for storing ink information and replaceably received in a pressure tank, a sub-tank communicating with an ink jet head and storing the ink sent from the main tank by pressure in the pressure tank, a tank-accommodating block for accommodating the main tank together with the pressure tank, and a control section capable of storing ink information, wherein in response to a signal indicative of an ink fill-up/shortage condition of the sub-tank, the ink jet recording apparatus supplies the ink in the main tank to the sub-tank by opening and closing a valve arranged on an upstream side of the sub-tank, and stores an amount of ink consumed by operation of the ink jet head, a number of times of ink replenishment to the sub-tank, an ink capacity of the main tank, in the control section, as the ink information, the method comprising the step of;

adding an amount of ink consumed through the sub-tank as an amount of ink consumed through the main tank when ink starts to be supplied to the sub-tank, and storing the resulting amount in the control section, and resetting the amount of ink consumed through the sub-tank;

counting the number of times of ink replenishment to the sub-tank for storage in the control section when ink starts to be supplied to the sub-tank; and resetting the number of times of ink replenishment to the sub-tank stored in the control section when the sub-tank is replaced.

12. A method of controlling an ink jet recording apparatus including a main tank having an information storage section for storing ink information and replaceably received in a pressure tank, a sub-tank communicating with an ink jet head and storing ink sent from the main tank by pressure in the pressure tank, a tank-accommodating block for accommodating the main tank together with the pressure tank, and a control section capable of storing the ink information, wherein in response to a signal indicative of an ink fill-up/shortage condition of the sub-tank, the ink jet recording apparatus supplies the ink in the main tank to the sub-tank by opening and closing a valve arranged on an upstream side of the sub-tank, and stores an amount of the ink consumed by operation of the ink jet head, a number of times of ink replenishment to the sub-tank, an ink capacity of the main tank, in the control section, as the ink information, the method comprising the steps of:

adding an amount of ink consumed through the sub-tank as an amount of ink consumed through the main tank when ink starts to be supplied to the sub-tank, and storing the resulting amount in the control section, and resetting the amount of ink consumed through the sub-tank;

writing the amount of ink consumed through the main tank into the information storage section of the main tank when there has occurred abnormal stoppage of the apparatus, when a door of the tank-accommodating block is opened during operation of the apparatus, when an initial ink-filling process for filling ink in the sub-tank is carried out, or when the ink in the main tank is used up; and writing a specific ink amount value exceeding a capacity of the main tank into the information storage section of the main tank, when the ink in the main tank is used up.

* * * * *